US007100626B2

(12) United States Patent
Livacich

(10) Patent No.: US 7,100,626 B2
(45) Date of Patent: Sep. 5, 2006

(54) LIGHTWEIGHT PORTABLE CONCEALMENT MEANS AND METHODS

(75) Inventor: John Livacich, Sunnyvale, CA (US)

(73) Assignee: Evrio, Inc., Sunnyvale, CA (US)

( * ) Notice: Subject to any disclaimer, the term of this patent is extended or adjusted under 35 U.S.C. 154(b) by 0 days.

(21) Appl. No.: 10/161,986

(22) Filed: Jun. 4, 2002

(65) Prior Publication Data

US 2002/0189660 A1 Dec. 19, 2002

Related U.S. Application Data

(60) Provisional application No. 60/295,956, filed on Jun. 4, 2001.

(51) Int. Cl.
*E04H 15/04* (2006.01)

(52) U.S. Cl. ..... 135/90; 135/117; 135/901

(58) Field of Classification Search ..... 160/335, 160/336, 337, 330, 125; 211/105.2; 248/261; 135/90, 117, 119, 20.1, 21, 901, 902; 43/1
See application file for complete search history.

(56) References Cited

U.S. PATENT DOCUMENTS

| | | | | | |
|---|---|---|---|---|---|
| 891,622 | A | * | 6/1908 | Kroder | 211/105.2 |
| 926,945 | A | * | 7/1909 | Howland | 211/105.2 |
| 1,079,431 | A | * | 11/1913 | Nitka | 160/330 |
| 1,298,634 | A | * | 4/1919 | Allen | 160/125 |
| 1,435,110 | A | * | 11/1922 | Efford | 211/96 |
| 1,528,910 | A | * | 3/1925 | Carlson | 211/96 |
| 1,572,845 | A | * | 2/1926 | Efford et al. | 211/96 |
| 2,175,501 | A | * | 10/1939 | Bergh | 211/100 |

* cited by examiner

*Primary Examiner*—David Purol

(57) ABSTRACT

An easy to use, simple, lightweight, compact, portable system of concealment and methods for its construction and use. The concealment system comprises a support and a curtain. The support attaches to a structure and pivots on the attachment. Various embodiments include multiple supports and multiple curtains. A method of hiding in front of a similar pattern.

37 Claims, 25 Drawing Sheets

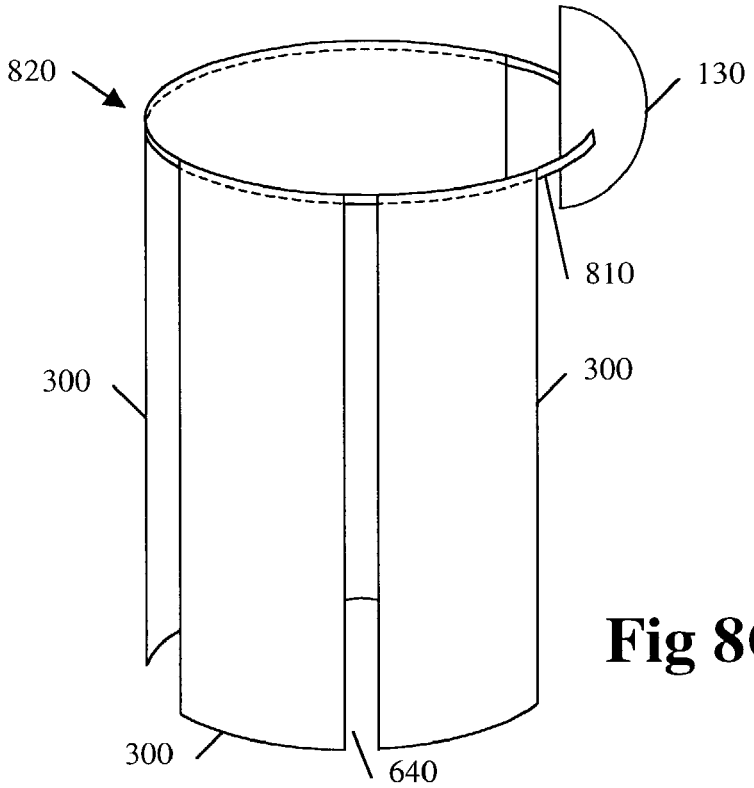
Fig 8C
Fig 8D
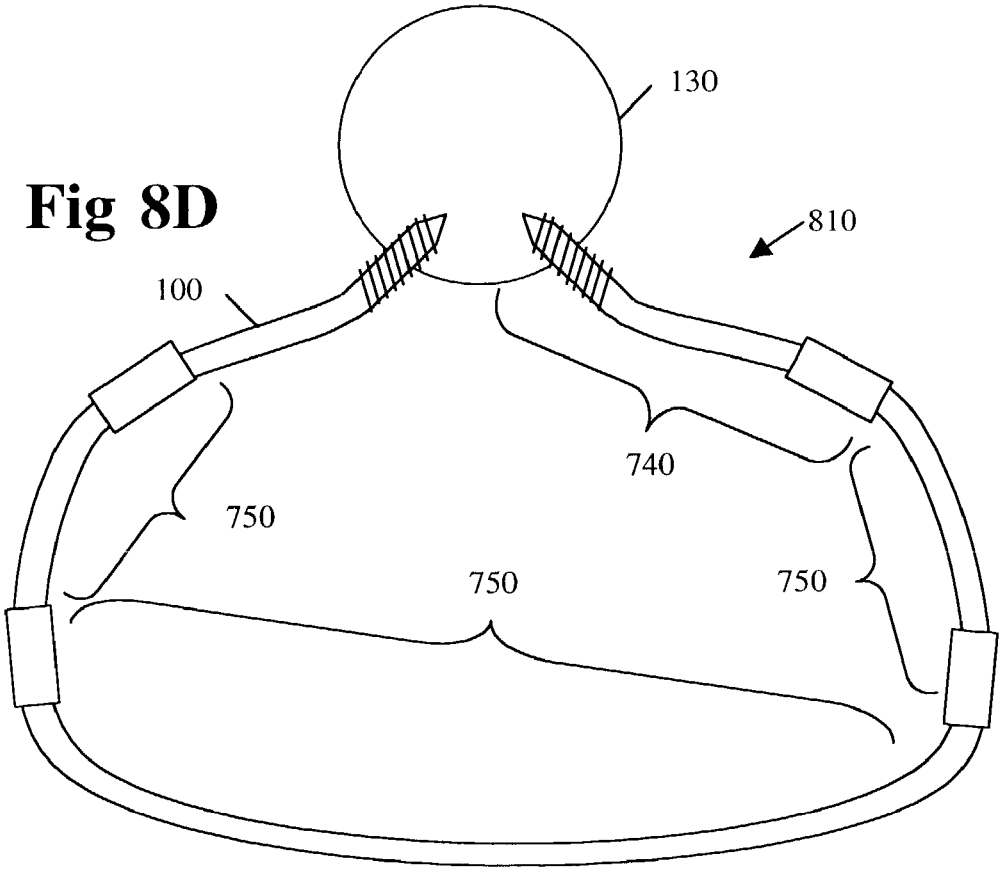

LIGHTWEIGHT PORTABLE CONCEALMENT MEANS AND METHODS

RELATED APPLICATIONS

This application claims priority under 35 U.S.C. § 199(e) of the co-pending U.S. provisional application Ser. No. 60/295,956, filed Jun. 4, 2001 entitled "LIGHTWEIGHT PORTABLE CONCEALMENT MEANS AND METHODS". The specification provisional application Ser. No. 60/295,956, filed Jun. 4, 2001 entitled "LIGHTWEIGHT PORTABLE CONCEALMENT MEANS AND METHODS" is also hereby incorporated by reference. The provisional claims of the provisional application are explicitly excluded.

BACKGROUND—FIELD OF THE INVENTION

This invention relates to lightweight portable concealment devices and methods.

BACKGROUND—DESCRIPTION OF PRIOR ART

There is often a need to conceal oneself when researching wildlife, hunting, camping, working on construction projects, or working in the outdoors. Wildlife researchers conceal themselves so that they can film and study wildlife without disturbing the behavior of the animals. Hunters often conceal themselves in various hunting blinds to avoid being detected by their prey. Campers often conceal themselves to bathe, change clothes, and perform other personal or hygiene activities. Construction workers, military, law enforcement, and others who work in the outdoors also have similar needs for concealment. Various methods have been employed to accomplish these tasks.

In the past, quite complex, heavy structures have been built or constructed for concealment. Hunters have built permanent hunting blinds. Portable huts, shower stalls, dressing shelters, tents, canopies, and complex tree blind structures have been carried into the great outdoors.

The following is a list of patents relating to this field of invention:

- U.S. Pat. No. 5,845,665 Demountable structure
- U.S. Pat. No. 5,836,330 Suspended overhead canopy assembly and method thereof
- U.S. Pat. No. 5,630,439 Portable hut
- U.S. Pat. No. 5,613,512 Blind structure for use with tree stand
- U.S. Pat. No. 4,825,578 Portable blind apparatus
- U.S. Pat. No. 4,813,441 Camouflage device for hunter's seat
- U.S. Pat. No. 4,719,934 Stable lightweight shelter structure
- U.S. Pat. No. 4,505,286 Portable shelter
- U.S. Pat. No. 4,597,401 Light weight tent
- U.S. Pat. No. 4,449,542 Portable hunting blind
- U.S. Pat. No. 5,385,165 Hunting blind
- U.S. Pat. No. 4,926,892 Temporary enclosing structure
- U.S. Pat. No. 3,913,598 Hunter's blind and shelter
- U.S. Pat. No. 5,628,338 Collapsible blind
- U.S. Pat. No. 4,788,997 Portable blind
- U.S. Pat. No. 5,361,794 Unitized foldable tent frame
- U.S. Pat. No. 4,751,936 Portable field blind
- U.S. Pat. No. 5,669,403 Hunting blind adapted to be mounted in a tree

- U.S. Pat. No. 5,822,906 Pit blind for interacting with wildlife and method of installation and use thereof
- U.S. Pat. No. 5,803,694 Portable tree platform elevated with a winch
- U.S. Pat. No. 5,528,849 Camouflage tube, a portable camouflage concealment structure
- U.S. Pat. No. 5,377,711 Camouflage blind for hunters
- U.S. Pat. No. 3,690,334 Portable hunting blind
- U.S. Pat. No. 5,127,180 Camouflage device for archery bow
- U.S. Pat. No. 5,062,234 Portable blind
- U.S. Pat. No. 4,716,919 Portable blind with automatic opening top
- U.S. Pat. No. 4,683,672 Collapsible game blind
- U.S. Pat. No. 3,545,461 Tree suspended enclosure
- U.S. Pat. No. 3,925,828 Portable shower
- U.S. Pat. No. 5,970,536 Camp shower apparatus
- U.S. Pat. No. 5,311,620 Outdoor portable shower
- U.S. Pat. No. 5,446,930 Portable shower enclosure
- U.S. Pat. No. 5,564,138 Portable shower
- U.S. Pat. No. 5,937,452 Portable bathroom assembly The use of such devices has several disadvantages such as being heavy, bulky, noisy, expensive, and complicated to assemble or use. Most of these devices have only a single use with poor performance. There is a need for a simple, lightweight, compact, portable, multi-use means of concealment.

To avoid being detected by their scent, hunters and other wildlife observers climb trees using tree steps and then remain for hours in a tree stand watching and waiting for animals to pass by. However, a person in a tree stand makes a silhouette against the sky or background and is exposed to a 360 degree view. Animals can easily detect the human silhouette or movement. Further, if the person or equipment makes a noise the animal will know where to look. There is a need for a device that eliminates the silhouette.

Complicated equipment or procedures create a situation where a person may drop equipment or, even worse, fall from the tree stand. Most of the existing devices block the view or mobility of the person.

Metal objects screwed into trees are sometimes forgotten and become over grown by the tree. Later when the lumber is harvested and cut, the saw strikes the metal object and can cause severe damage. Some states have banded the use of metal tree screws or spikes. Any device used for attaching to trees in the forest needs an embodiment that attaches to the outside of the tree and can be easily removed.

SUMMARY OF THE INVENTION

Accordingly, it is an objective of the present invention to provide easy to use, simple, lightweight, compact, portable, quiet, multi-use means of concealment.

Objects and Advantages

Accordingly, beside the objects and advantages described above, some additional objects and advantages of the present invention are:

1. To provide an improved wildlife research blind.
2. To provide an improved hunting blind.
3. To provide an improved outdoor shower concealment means.
4. To provide an improved outdoor latrine concealment means.
5. To provide an improved tree stand concealment means.
6. To provide a quick, silent means of lowering or raising a screen.

7. To provide a pivotal means of attachment that maintains its frictional force.
8. To provide an option for attaching to the outside of a tree.
9. To provide unobstructed vision or shooting lanes.
10. To provide a means of concealment by hiding in front of a similar pattern.

These and other features and advantages of the present invention will become apparent upon consideration of the following specification, claims, and drawings.

DRAWING FIGURES

In the drawings, closely related figures have the same number but different alphabetic suffixes.

FIG. 8A through FIG. 8E show loop support embodiments.

REFERENCE NUMERALS IN DRAWINGS

Figure 1A:
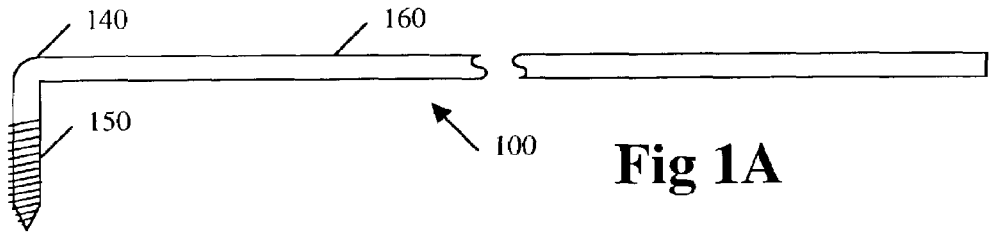
FIG. 1A through FIG. 1H shows various embodiments of the support of the present invention.

| | |
|---|---|
| 100 | attaching pivoting support |
| 102 | threaded support |
| 104 | threaded connector |
| 106 | shaft |
| 107 | segmented shaft |
| 108 | telescoping shaft |
| 110 | plate |
| 112 | plate connection |
| 114 | plate sleeve |
| 120 | drilled support |
| 122 | drilled receiving shaft |
| 124 | fastener |
| 126 | elastic cord |
| 130 | attaching structure |
| 140 | bend |
| 150 | first leg |
| 160 | second leg |
| 170 | cap |
| 180 | horizontal structure |
| 200 | attaching belt |
| 210 | strap |
| 220 | tension means |
| 230 | attaching fastener |
| 240 | threaded receptor |
| 300 | curtain |
| 302 | anchored curtain |
| 304 | draw-curtain |
| 306 | enhanced draw-curtain |

-continued

REFERENCE NUMERALS IN DRAWINGS

| | |
|---|---|
| 308 | window cover |
| 309 | windowed curtain |
| 310 | anchor point |
| 312 | edge hem |
| 314 | interior hem |
| 316 | grommet group |
| 318 | support hem |
| 320 | see-through |
| 322 | window |
| 324 | window grommet |
| 340 | tie |
| 350 | slit |
| 352 | slit cord |
| 354 | side grommet |
| 356 | pull loop |
| 360 | cord cutout |
| 362 | drawstring clip |
| 364 | drawstring |
| 365 | drawstring knot |
| 366 | drawstring fastener |
| 368 | grommet |
| 369 | grommet reinforcement |
| 370 | first anchor point |
| 380 | second anchor point |
| 390 | third anchor point |
| 400 | operator |
| 410 | path |
| 510 | hem reinforcement |
| 520 | fastening strap |
| 530 | hook and loop fastener |
| 600 | T-shaped support |
| 605 | cross bar |
| 610 | first ring end |
| 620 | second ring end |
| 630 | ring |
| 640 | curtain opening |
| 700 | straight connector |
| 710 | angled connector |
| 720 | reinforced angled connector |
| 730 | connector reinforcement |
| 740 | support with angled connector |
| 750 | shaft with angled connector |
| 760 | connected shaft |
| 770 | connector insert |
| 780 | top rail |
| 782 | bottom rail |
| 784 | rail ring |
| 790 | flexible connector |
| 800 | double support ring |
| 810 | segmented ring |
| 820 | curtained ring |
| 900 | supporting cord |
| 910 | hoop |
| 915 | overhead structure |
| 920 | eye fastener |
| 925 | knotted connector |
| 930 | connector with eye loop |
| 935 | eye loop |
| 940 | second cord |
| 1010 | first example |
| 1020 | second example |
| 1025 | friction pivot joint |
| 1030 | third example |
| 1040 | fourth example |
| 1050 | fifth example |
| 1060 | sixth example |
| 1100 | strap hole |
| 1110 | attaching material |
| 1120 | attaching hole |
| 1130 | tooth |
| 1150 | stopper |
| 1300 | case |
| 1310 | belt loop |
| 1320 | stake |

SPECIAL DEFINITIONS cord—a flexible, and possibly elastic, filament including but not limited to a fiber, thread, string, rope, twine, wire, cable, yarn, thong, tendon, or line.

curtain—a concealing or protecting sheet of material.

grommet—a flexible loop that serves as a fastening, support, or reinforcement or an eyelet of firm material to strengthen or protect an opening or to insulate or protect something passed through it.

shaft—a supporting member in construction including but not limited to any solid or hollow, round or rectangular bar, beam, pole, rod, spar, or tube composed of wood, plastic, metal, or composite material.

telescoping shaft—an expandable and collapsible shaft having parts that slip over each other.

DESCRIPTION OF THE INVENTION

The present invention comprises an easy to use, simple, lightweight, compact, portable means of concealment and methods for its construction and use. The main components of the concealment means are a support and a curtain. The support attaches to a structure and pivots on the attachment. The present invention encompass various embodiments of the attaching pivoting support as well as various embodiments of curtains with various features. A method of the present invention allows for 360 degree concealment. In addition to a method of being fully enclosed, a method of the present invention is based on the concept of "hiding in front" of a similar pattern.

FIG. 1A through FIG. 1H

FIG. 1A illustrates an attaching pivoting support 100. The support 100 is bent at an angle. The bend 140 results in two legs: a first leg 150 and a second leg 160. The first leg 150 has a threaded portion for threaded attachment to an attaching structure 130, such as a tree, pole, rock, wall, or attaching fastener 230. The bend 140 allows a user to exert a force on the second leg 160 that acts as a lever to screw the first leg 150 into the attaching structure 130.

The angle of the bend 140 is shown as a 90 degree angle; however, good results have also been obtained by using an obtuse angle. An obtuse angle still provides a leveraged force but is less likely to cause the second leg 160 to be blocked by tree branches or other obstructions.

In this exemplary embodiment, a portion of the threaded portion of the first leg 150 is cylindrical, not tapered, so that once attached to the attaching structure 130, the second leg 160 can be rotated up and down around the first leg 150 without loosing frictional force necessary to hold the attaching pivoting support 100 in the position the operator leaves it (as will be explained below).

The attaching pivoting support 100 can be constructed of a single shaft. However, depending on construction materials, a lighter embodiment can be constructed by combining various components. This invention anticipates that any combination of parts can be used to make the attaching pivoting support 100 with equivalent structural features and functions. Examples of some embodiments are shown in FIG. 1B through FIG. 1F.

Figure 1B:
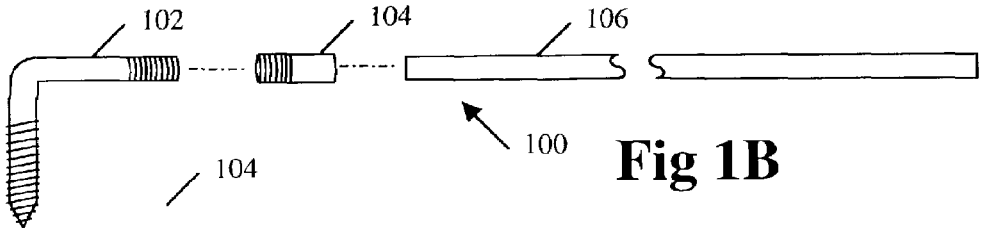

FIG. 1B shows an exploded view of the attaching pivoting support 100 comprised of a threaded support 102, a threaded connector 104, and a shaft 106. The threaded connector 104 screws onto the threaded support 102 and is attached to the shaft 106. Good results have been obtained by making the threaded support 102 from hardened steel, by making the threaded connector 104 from an aluminum alloy tube, and by making the shaft 106 from fiberglass. Good attachment results have been obtained by gluing or crimping the aluminum tube to the fiberglass.

Figure 1C:
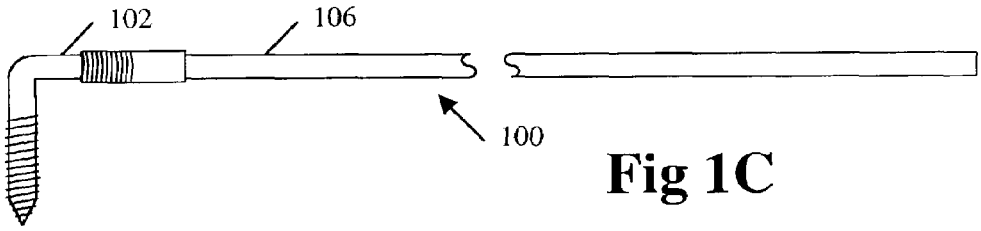

FIG. 1C shows an assembled view of the example shown in FIG. 1B.

Figure 1D:
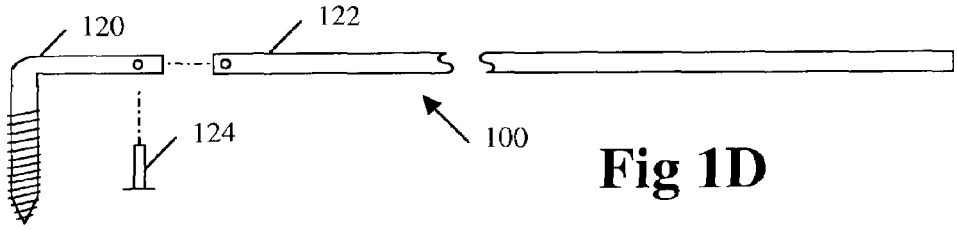

FIG. 1D shows an exploded view of the attaching pivoting support 100 comprised of a drilled support 120 and a drilled receiving shaft 122. The drilled support 120 is inserted into a cavity in the drilled receiving shaft 122 and is held in place by a fastener 124. Both the drilled support 120 and the drilled receiving shaft 122 are drilled to receive the fastener. The faster 124 could be a nail, screw, rivet, bolt and nut clasp, or similar means of attachment. Good results have been obtained by making the drilled support 120 from hardened steel and by making the drilled receiving shaft 122 from an aluminum alloy, plastic tube, or hollow fiberglass shaft.

Figure 1E:
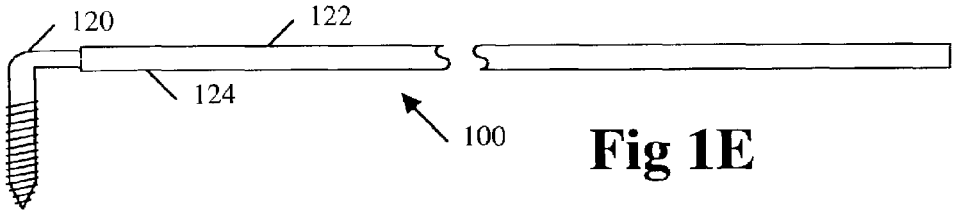

FIG. 1E shows an assembled view of the example shown in FIG. 1D.

Figure 1F:
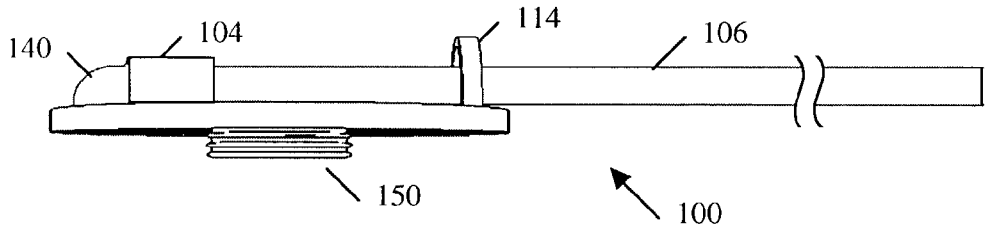

FIG. 1F shows an embodiment of the attaching pivoting support 100 comprised of a plate 110 with a plate connection 112 for attaching the shaft 106. The shaft 106 can be inserted through a plate sleeve 114 and attached by threads to the plate connection. The plate sleeve 114 provides added stability to the connection. The plate 110 is functionally equivalent to the bend 140 that connects the first leg 150 to the second leg 160. Good results have been obtained by making the plate 110 from a high polymer plastic, and by making the shaft 106 from fiberglass. It may be desirable to make the first leg 150 with a large diameter and a short length.

Good results have also been obtained by attaching the threaded connector 104 to the shaft 106 as shown in FIG. 1B and FIG. 1C. Good attachment results have been obtained by gluing or crimping the aluminum tube to the fiberglass. Gluing the aluminum tube to the fiberglass creates a weld that distributes the force more evenly across the fiberglass shaft; this reduces the breakdown of the fiberglass that can shatter or fray when the forces are applied to a smaller area.

Figure 1G:
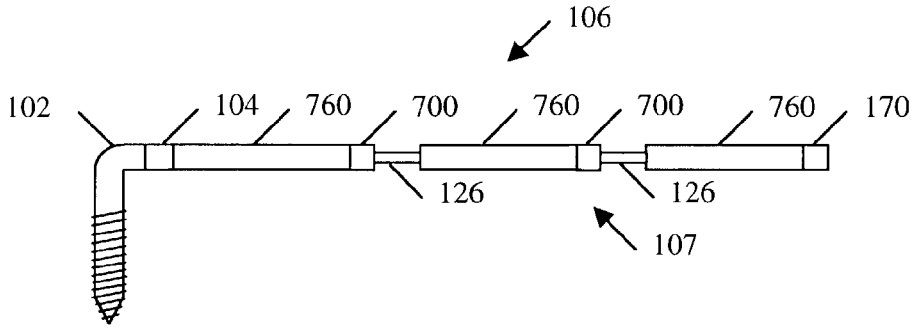

FIG. 1G shows an embodiment of the attaching pivoting support 100 comprised of the threaded support 102, the threaded connector 104, and the shaft 106. As in FIG. 1B, the threaded connector 104 screws onto the threaded support 102 and is attached to the shaft 106. However, in this embodiment the shaft 106 is comprised of a plurality of connected shafts 760 each connected to a connector. In this embodiment each connected shaft 760 is connected to a straight connector 700. These form a segmented shaft 107.

FIG. 1G further shows an example where the shafts are hollow and connected with an elastic cord 126. The elastic cord 126 running through the centers of the shaft 106 components (such as 100, 700, 710, 720, 740, 750, 760, 770, or 780) can connect the components. This can prevent components from falling and makes it easier to assemble the shaft 106.

Figure 1H:
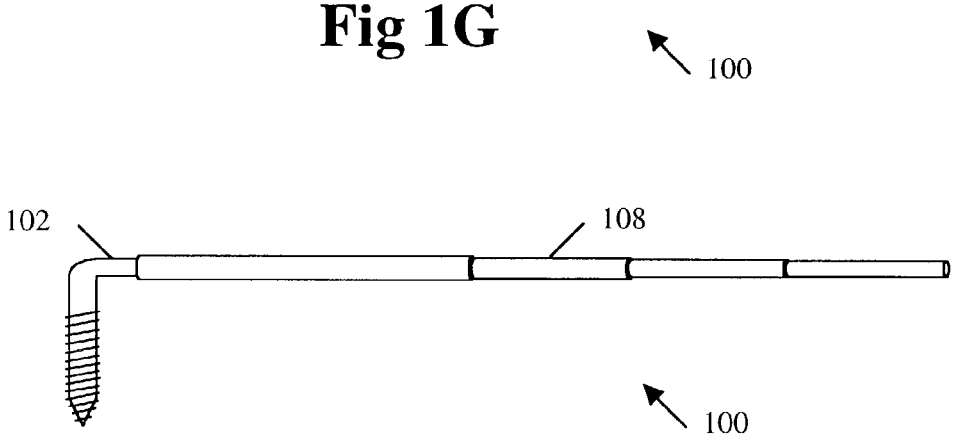

FIG. 1H shows an embodiment of the attaching pivoting support 100 comprised of the threaded support 102, the threaded connector 104, and the shaft 106. As in FIG. 1B, the threaded connector 104 screws onto the threaded support 102 and is attached to the shaft 106. However, in this embodiment the shaft 106 is comprised of a telescoping shaft 108 comprising a plurality of concentric shafts that slide inside each other to extend for use and to collapse inside the outer shaft for storage. The telescoping shaft 108 could be one as known in the art, such as is commonly used for car or portable radio antennae, or one of a new design.

The free end of the shaft 106 can optionally be covered with a cap 170 that can protect the end of the shaft from breaking, protect the user, and make it easier to pass material over the end of the shaft 106.

FIG. 2A

Figure 2A:
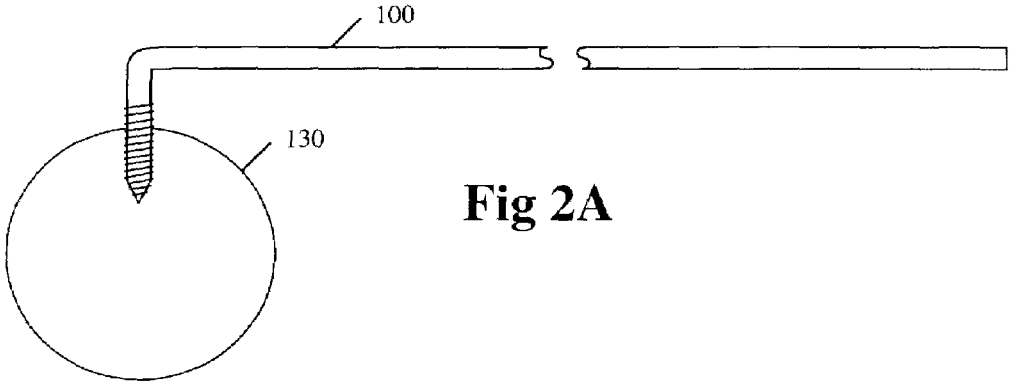
FIG. 2A and FIG. 2B show the support attached to an attaching support.

FIG. 2A shows a top cross-sectional view of the attaching pivoting support 100 attached to the attaching structure 130. In this example the attaching structure 130 is shown as tree or a wooden pole. As will be shown later, the attaching structure 130 may comprise scaffolds, buildings, or devices composed of straps, belts, or other components further attached to trees or other structures.

Figure 2B:
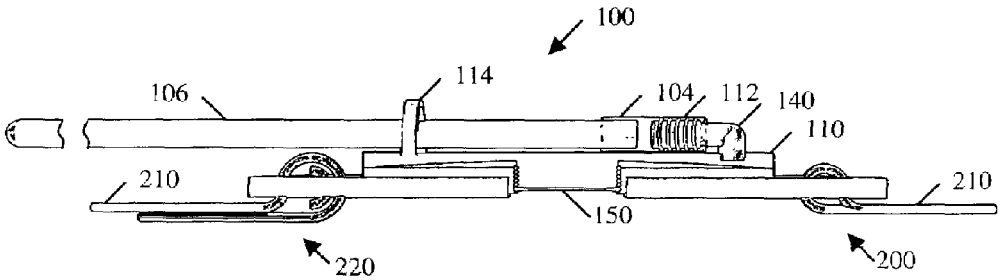
Figure 2C:
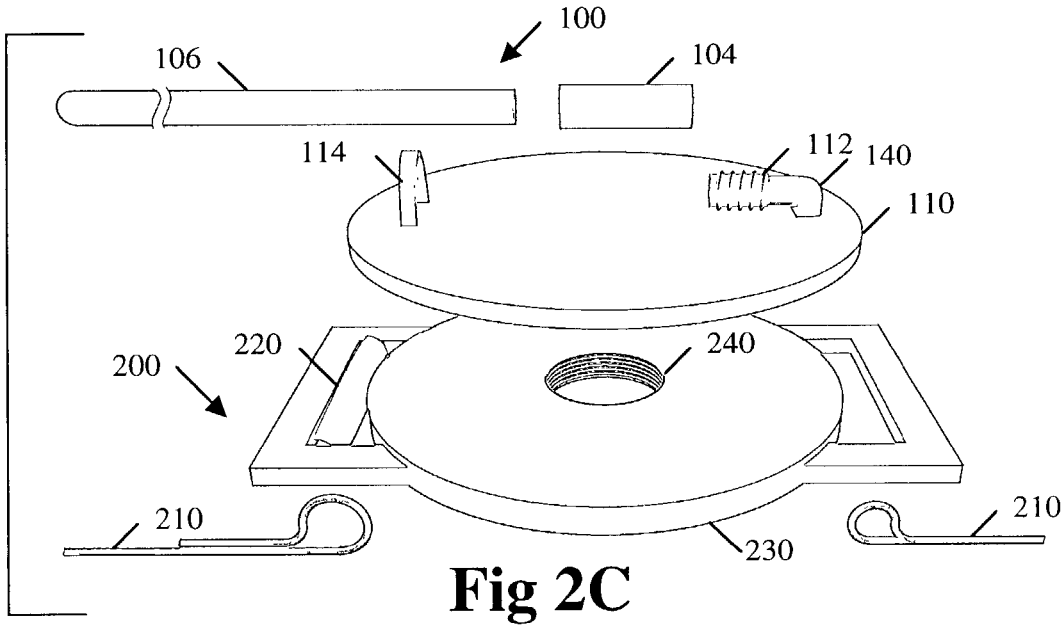
FIG. 2C and FIG. 2D show views of the embodiment of FIG. 2B.
Figure 2D:
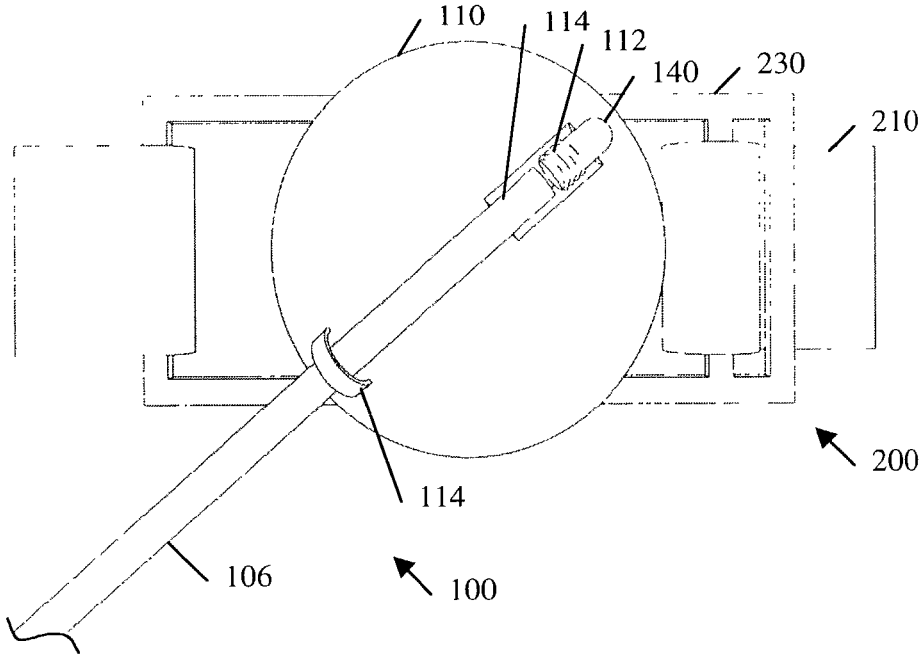

In one normal use, the second leg 160 is extended generally horizontally. In this simplest embodiment of the present invention, the operator could drape a sheet, coat, poncho, garbage bag, tarp, or other available material over the attaching pivoting support 100 to form a means of concealment. FIG. 2B through FIG. 2D FIG. 2B shows the attaching pivoting support 100, as shown in FIG. 1F, attached to the attaching structure 130 comprising an attaching belt 200. The attaching belt 200 includes a strap 210 attached to an attaching fastener 230. The attaching fastener 230 contains a threaded hole that is capable of receiving the threaded first leg 150. The side of the plate 110 which is adjacent to the first leg 150 may be tapered so that the deeper it is threaded in the hole, the greater the friction between the plate 110 and the attaching fastener 230.

Figure 11A:
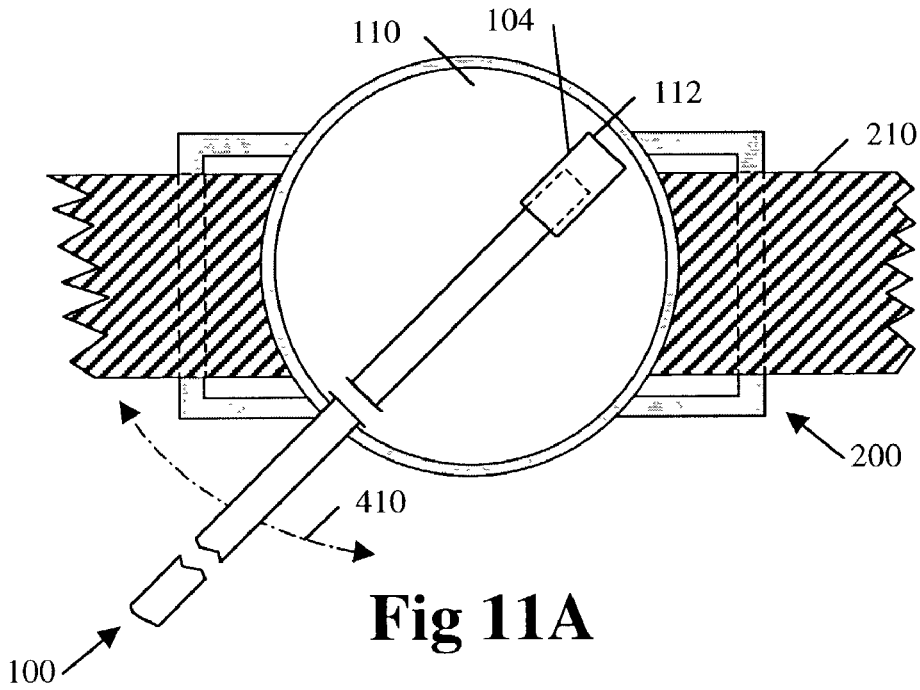
FIG. 11A through FIG. 11F show alternate embodiments.

The strap 210 could pass through openings on each end of the attaching fastener 230 (as shown in FIG. 11A). Alternatively, the strap 210 can be permanently fastened to one end, passed around a tree or similar structure and then tightened against the structure by passing the loose end of the strap 210 through a tension means 220 on the opposite end. One embodiment of the tension means 220 is shown in FIG. 2B. Other equivalent means are known in the art.

FIG. 2C shows an exploded view of the attaching pivoting support 100 and the attaching belt 200 as shown and described in FIG. 2B. The first leg 150 is not visible in this view but would attach at a threaded receptor 240 in the attaching fastener 230.

FIG. 2D shows a different view of same components shown and described in FIG. 2B and FIG. 2C. This view shows how the shaft 106 pivots around the center of the first leg 150 and the plate 110. The shaft 106 is shown in a lowered position relative to the strap 210 which is shown horizontally as if it were attached to the attaching structure 130, such as a tree or pole.

FIG. 3A through FIG. 3I

Figure 3A:
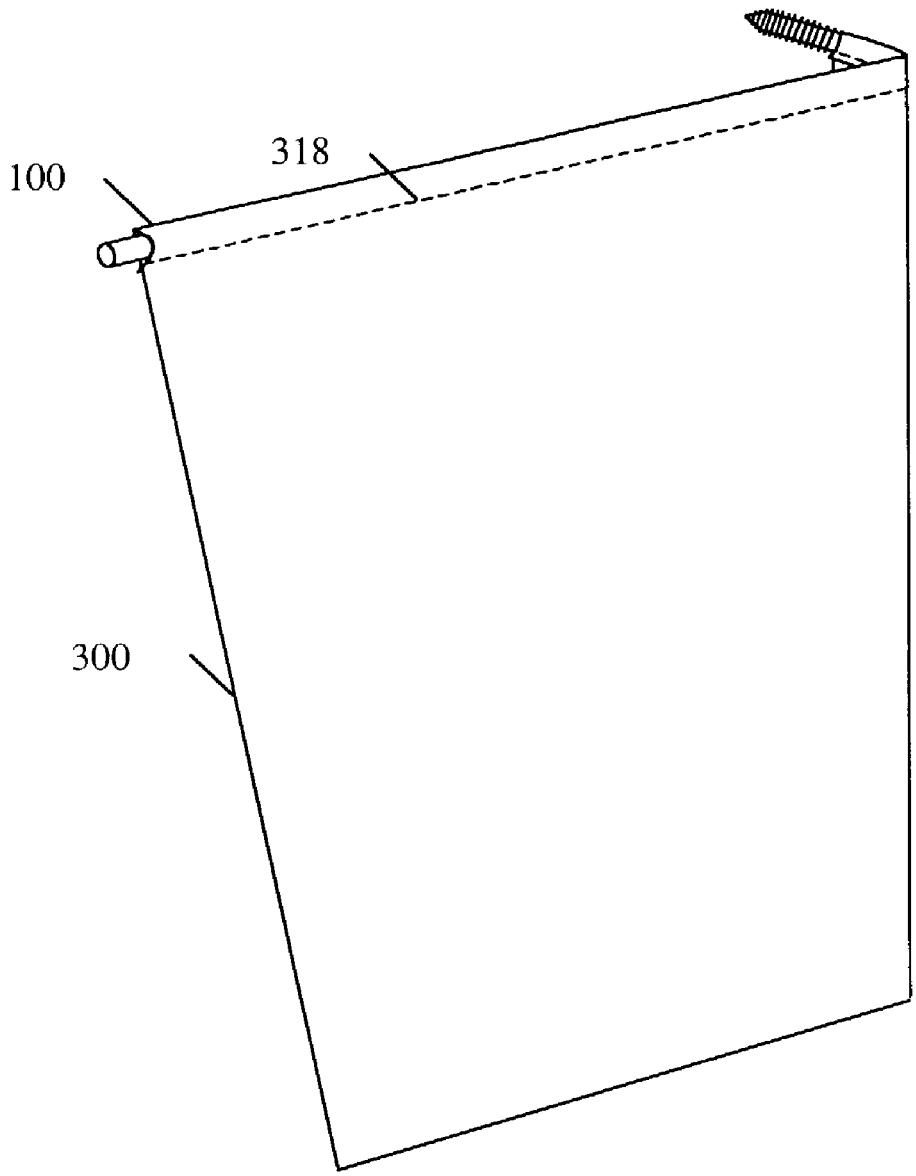
FIG. 3A shows the support combined with a curtain.

FIG. 3A shows an embodiment of the present invention where a curtain 300 is hanging from the attaching pivoting support 100. In this example, the curtain is a sheet of material with a support hem 318 sewn or sealed along the top edge. Good results have been obtained by making the curtain from camouflaged woven material or plastic sheeting. The attaching pivioting support 100 is passed through the support hem 318 of the curtain 300.

Figure 3B:
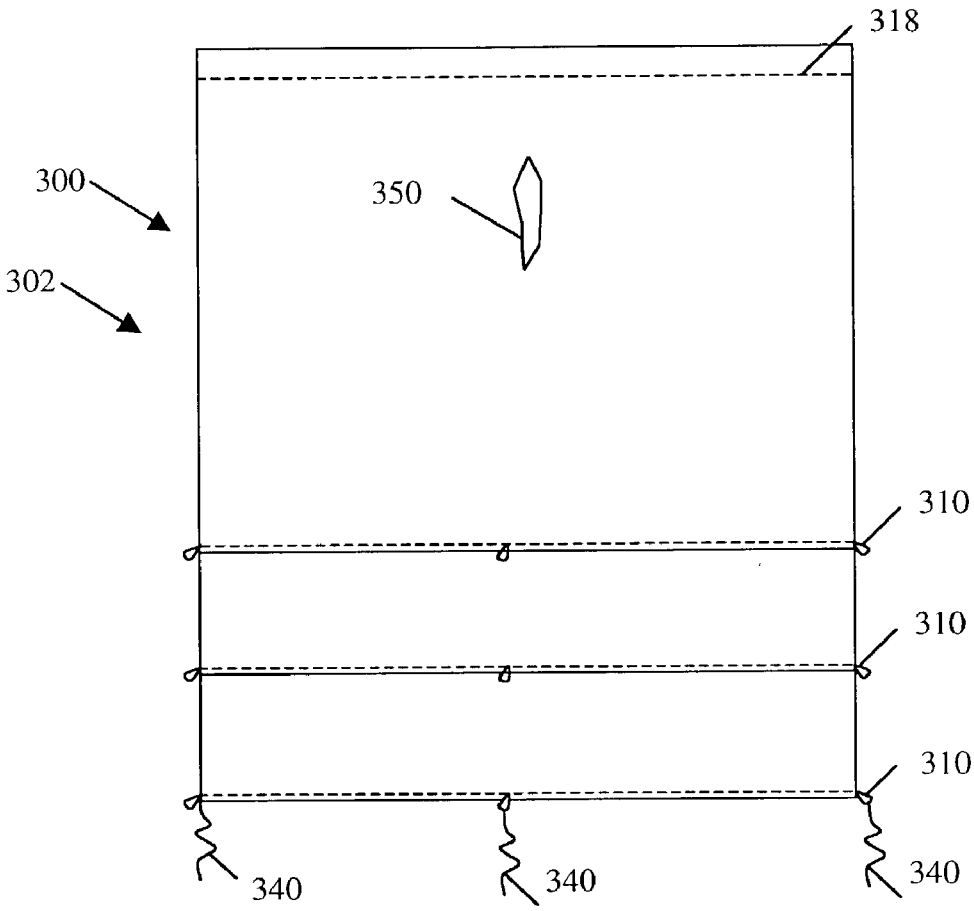
FIG. 3B through FIG. 3L show details of curtain embodiments.

FIG. 3B shows an anchored curtain 302 which is an embodiment of the curtain 300 with multiple anchor points 310 and ties 340. Each tie 340 can be used to adjust the effective length, or the effective shape, of the curtain by attaching to one of the anchor points 310. The attaching points 310 and the ties 340 can hold the curtain 300 taut to avoid noise caused by wind.

A slit 350 can optionally be placed in the curtain 300 to allow the person to peak through the curtain 300 without lowering the attaching pivoting support 100.

Figure 3C:
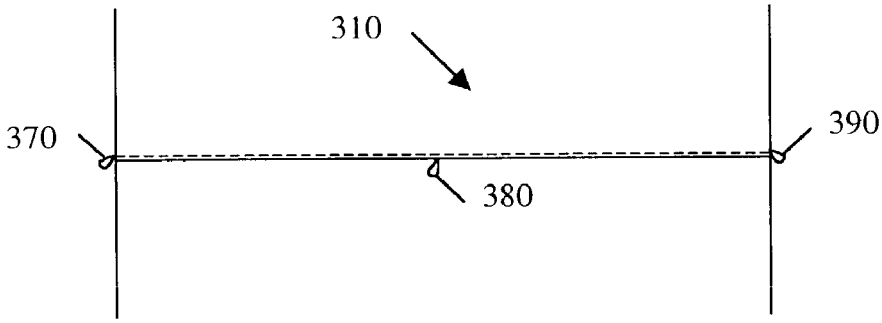

FIG. 3C shows the detail of a row of anchor points 310. In this example, there is a first anchor point 370, as a second anchor point 380, and a third anchor point 390. Good results have been obtained by sewing a stretch cord into a hem such that the stretch cord forms the first and third anchor points (370 and 390) on the sides of the curtain, and the second anchor point 380 in between. The anchor points (370, 380, and 390) each are examples of a grommet 368 as used in the present invention.

A shaft could be placed through the anchor points 310 to make the curtain more rigid.

In an embodiment where more than one curtain 300 is used, the curtains can be tied together with the ties 340, or a shaft could be inserted into adjacent anchor points 310.

One method of using the present invention is to attach the attaching pivoting support 100 to a limb and position it vertically and attach the ties 340 to the tree trunk such that the curtain is held generally horizontally (see FIG. 4E below).

Regardless of the position, the shaft 106 or second leg 160 of the attaching pivoting support 100 provides tension on the curtain 300 to hold it tight in the wind.

Figure 3D:
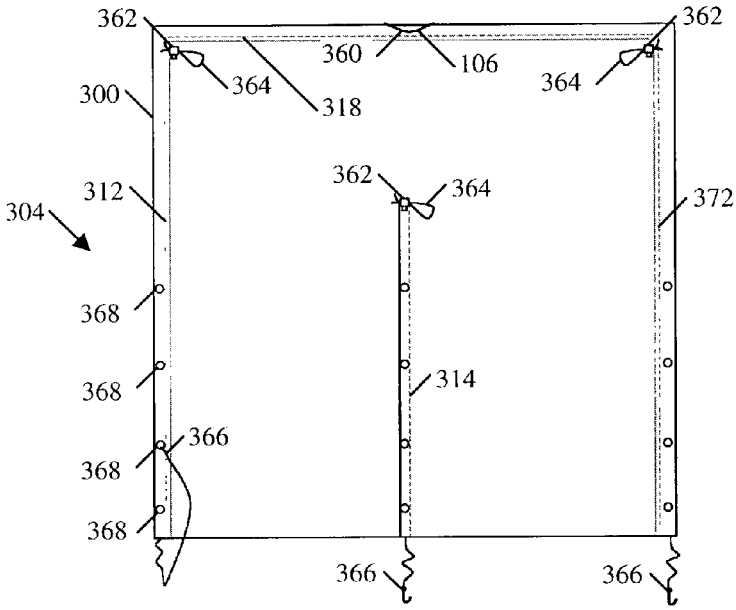

FIG. 3D shows a draw-curtain 304, which is an embodiment of the curtain 300 with one or more drawstrings 364. In this exemplary embodiment, in addition to the support hem 318, there is an edge hem 312 on each side of the curtain. Optionally, there could be one (as shown) or more interior hems 314 in the material between the edges. Each edge hem 312 or interior hem 314 forms a sleeve or path through which a drawstring 364 can pass. One end of the drawstring is attached to a drawstring fastener 366. The drawstring fastener 366 could be a permanent attachment to the draw-curtain 304. However, it is advantageous to have the drawstring fastener 366 be a moveable attachment, such as a hook or snap. A moveable version of the drawstring fastener 366 could be attached to one of a plurality of grommets 368 that can be placed in the curtain 300. Each grommet could be a loop of flexible material (as shown in FIG. 3B and 3C) or a firm eyelet (as shown in FIG. 3D, 3E, 3F, 3H and 3I). The other of end of the drawstring 364 is drawn in a loop that is passed through a drawstring clip 362. The drawstring clip 362 prevents this end of the drawstring 364 from going through the respective hem (312 or 314). When the drawstring fastener 366 is attached to a grommet 368 above the bottom of the draw-curtain 304, the material at the bottom of the curtain is drawn up shortening the effective length of the curtain. Typically, the drawstring fastener 366 end of the drawstring 364 is also passed around a fixed object, such as a tree branch, a tree trunk (as shown in FIG. 4E below), a tree stand (as shown if FIG. 4C below), or a stake 1320. The extra length of the drawstring 364 can be drawn through the drawstring clip 362. The tension between the fixed object at the drawstring fastener 366 end of the drawstring 364 and the drawstring clip 362 keeps that section of the drawstring 364 and the draw-curtain 304 taut. By securing each drawstring 364 as explained here, the length and shape of the draw-curtain 304 can be adjusted and the draw-curtain 304 is held tight so that its material is less likely to move or make noise in the wind. This layout makes it easier and safer to manipulate or adjust the curtain 300. Being able to move the drawstring fastener 366 and adjust the length of the drawstring 364 using the drawstring clip 362 without bending over and reaching all the way to the bottom of the curtain 300 is valuable when the user is high on a tree stand. The user can make adjustments while sitting or standing.

FIG. 3D shows the interior hem 314 being shorter than the edge hem 312 teaching that technique can be used with the hem (312 or 314) only going up a portion of the curtain 300. This could reduce the cost of the system and provide room for the slit 350 or a window 322.

FIG. 3D also shows an optional cord cutout 360 in the support hem 318. This allows a supporting cord 900 to be attached to any shaft or connector passing through the support hem 318. See FIG. 9A through 9E below.

Figure 3G:
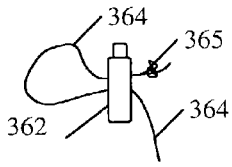
Figure 3H:
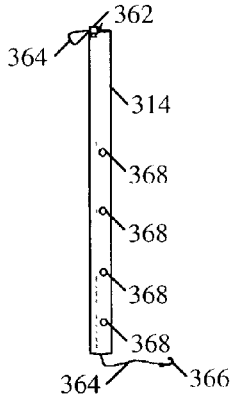
Figure 3E:
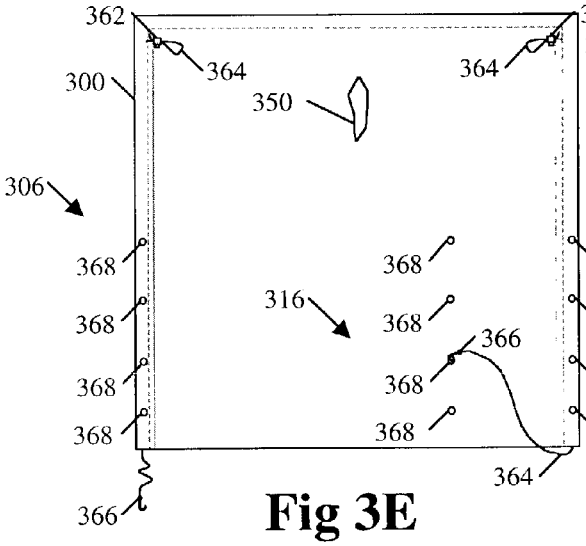

FIG. 3E shows an enhanced draw-curtain 306, which is an embodiment of the draw-curtain 304 with one or more extra grommets 368. In this exemplary embodiment, in addition to the grommets near the edge hem, there is a grommet group 316 placed in the interior of the curtain 300. When the drawstring fastener 366 is attached to one of the interior grommets 368 a sideways (lateral) force is added to the force that draws up the bottom of the curtain 300. This sideways force can be used to change the shape of the curtain. The sideways force can be used to secure the curtain 300 around an object such as a tree or the base of the tree stand.

FIG. 3E also shows the optional slit 350 in the enhanced draw-curtain 306.

Figure 3F:
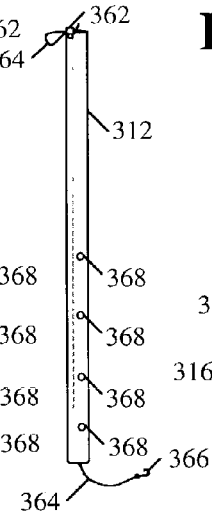

FIG. 3F shows details of the edge hem 312, drawstring clip 362, drawstring 364, drawstring fastener 366, and grommets 368.

FIG. 3G shows details of the extra length of the drawstring 364 being looped through the drawstring clip 362. A drawstring knot 365 keeps the end of the drawstring from passing through the drawstring clip 362. The user can pull on the loop while opening the drawstring clip 362 to draw more of the drawstring 364 beyond the drawstring clip 362. The user can relax the pressure on the loop while opening the drawstring clip 362 to release some of the drawstring 364 thus loosening or extending the draw-curtain 304.

FIG. 3H shows details of the interior hem 314, drawstring clip 362, drawstring 364, drawstring fastener 366, and grommets 368.

Figure 3I:
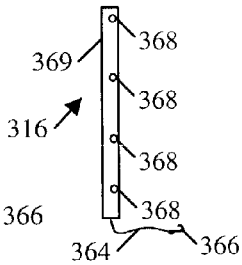

FIG. 3I shows the reinforced grommet group 316. In some cases where the curtain 300 material is light, it may be beneficial to reinforce the material receiving the grommets with a strip of grommet reinforcement 369

Figure 3J:
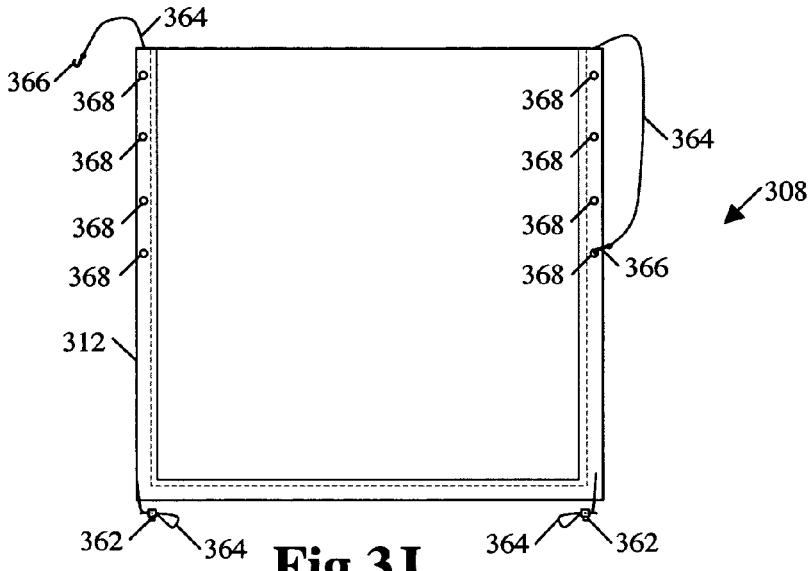
Figure 3K:
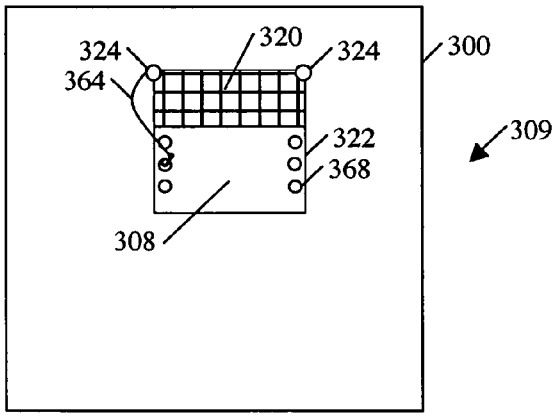

FIG. 3J and FIG. 3K show, a windowed curtain 309, which is an embodiment of the curtain 300 with one or more windows 322. The window 322 is a geometric shape cut in the curtain 300. The window can optionally be covered with a see-through 320. The see-through 320 is material that a person near the window can see through but other people or wildlife, on the other side or at a distance, cannot see through. For hunting, the see-through 320 could also be material that could be shot through with an arrow, dart, or bullet. The window 322 could also be covered with a window cover 308. As shown in detail in FIG. 3J, the window cover 308 operates like an upside down version of the drawn-curtain 304. The window cover has edge hems 312, each providing a channel for drawstring 364. The drawstring fastener 366 passes through a window grommet 324 at the top of the window 322 and then is attached to one of the grommets 368 near the edge hem 312. The length of the window cover 308 can be adjusted by moving the drawstring fastener 366 to a different grommet 368 and tightening the drawstring 364 where it passes through the drawstring clip 362.

Figure 3L:
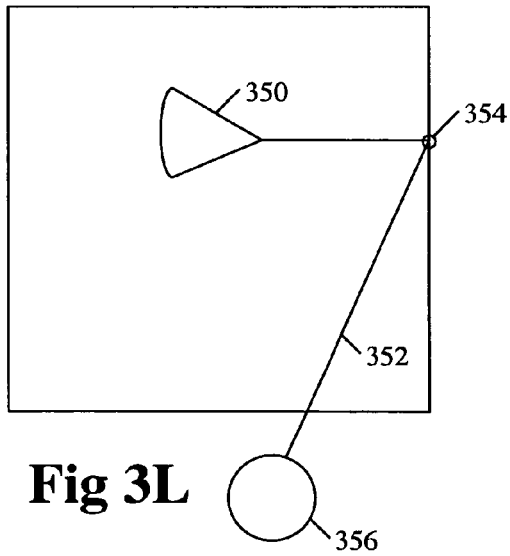

FIG. 3L shows an embodiment of the curtain 300 with the slit 350 being opened by a slit cord 352. In this example, the slit cord 352 passes through a side grommet 354 which acts as a pulley to redirect the force when the slit cord 352 is pulled. The free end of slit cord 352 can optionally be tied to form a pull loop 356. The operator can apply a force to the slit cord 352 by pulling directly on the slit cord 352 or optionally by placing the pull loop 356 around the operator's hand or foot. The force on the slit cord 352, opens the slit 350 allowing the operator to see, or shoot, through the curtain 300 without moving the curtain 300.

FIG. 4A

Figure 4A:
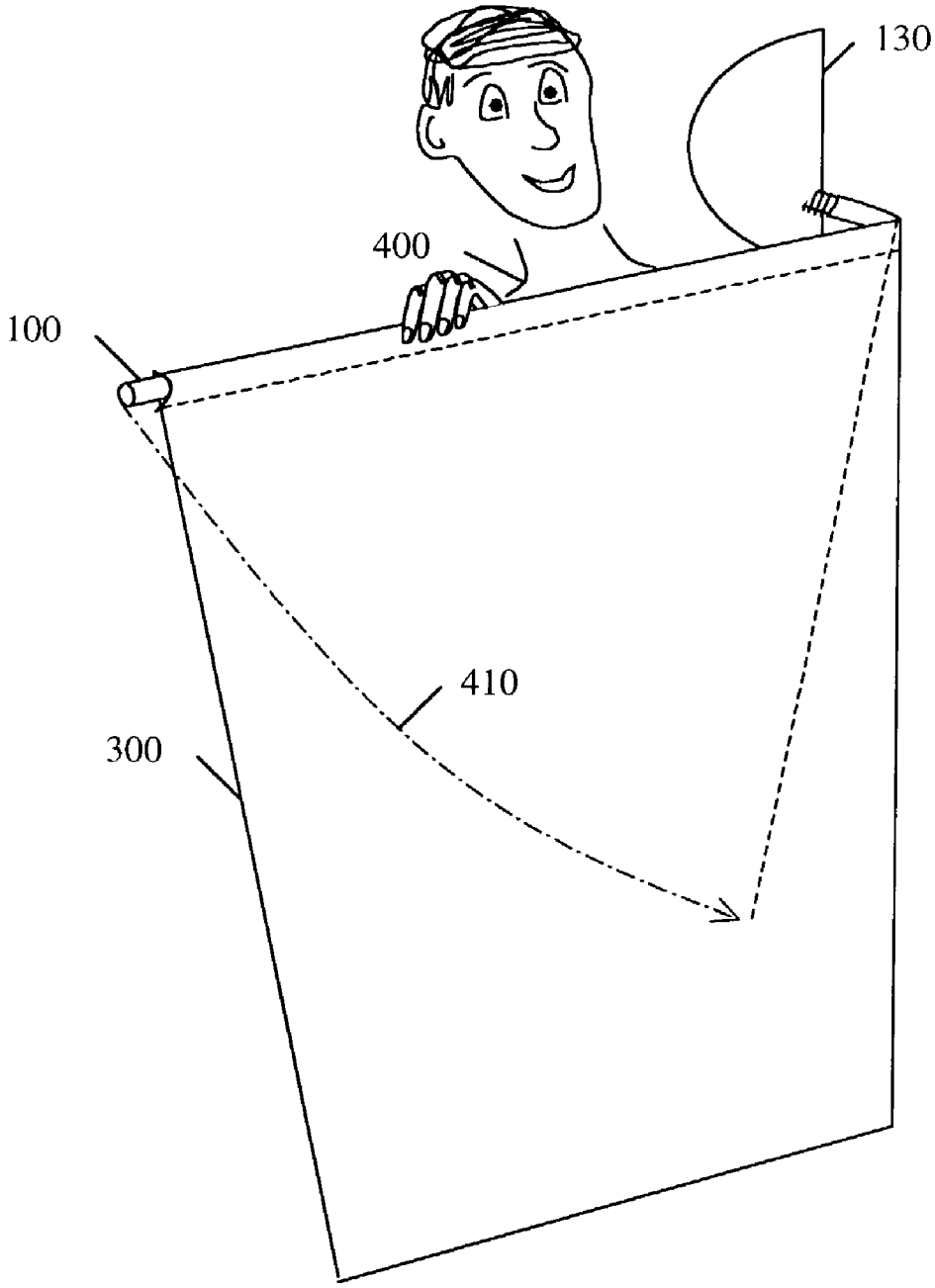
FIG. 4A through 4E show exemplary uses of the present invention.

FIG. 4A shows an operator 400 concealed by the present invention. The operator 400 may be washing or taking care of other personal hygiene.

The means of concealment can quickly and quietly be lowered as shown by an angular path 410. This allows the operator 400 to look over the curtain 300 or to shoot an arrow or fire a gun behind them without being obstructed by the means of concealment. After firing the user can quickly and quietly return the curtain 300 into its normal position as shown.

As explained earlier, one objective and advantage of the present invention is maintaining the frictional force of the first leg 150 with the attaching structure 130. This frictional force holds the attaching pivoting support 100 in place when not being moved by the operator 400. It should be clear that the operator 400 could also raise the curtain 300 so that the operator's head is also concealed.

Figure 4B:
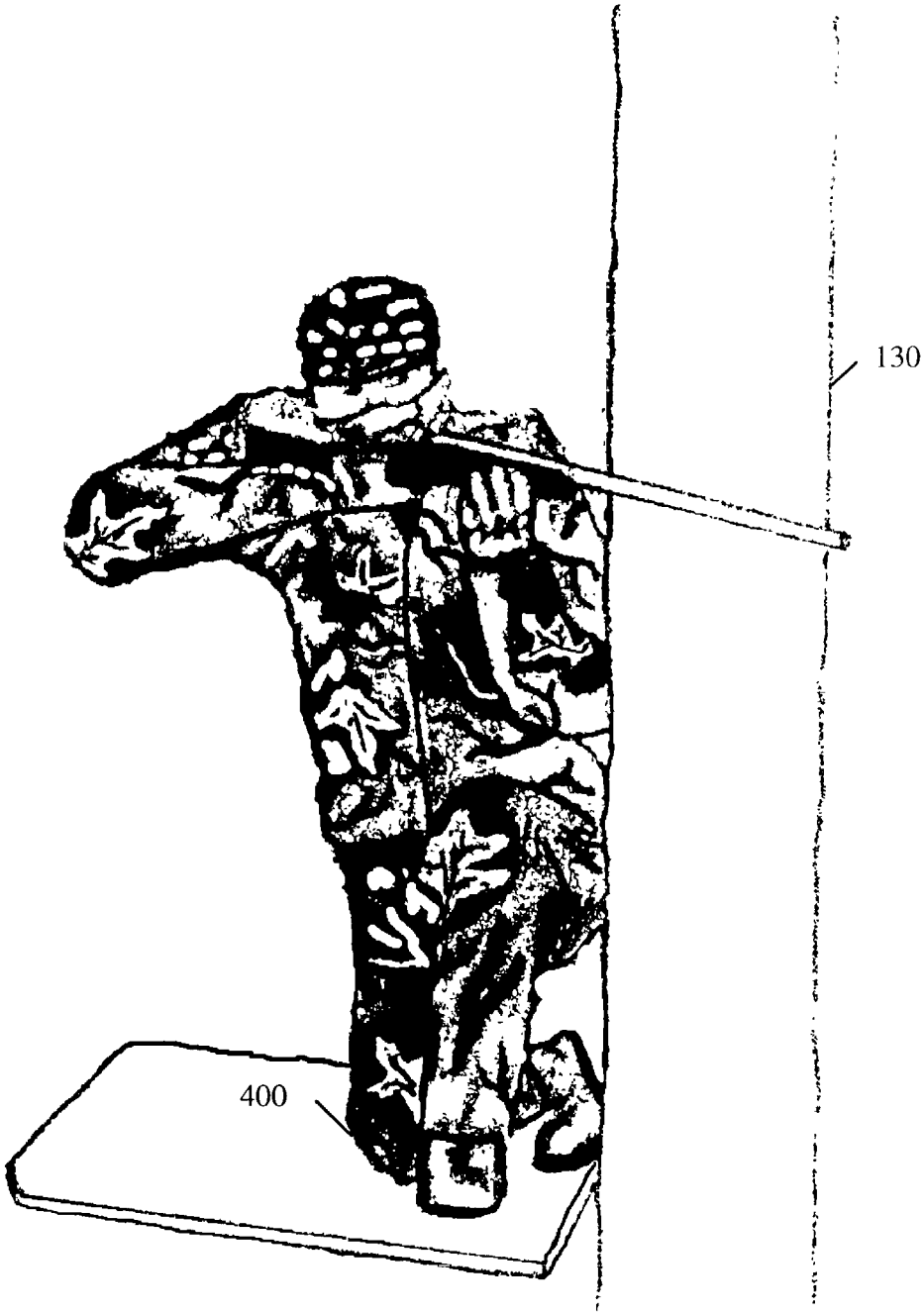
Figure 4C:
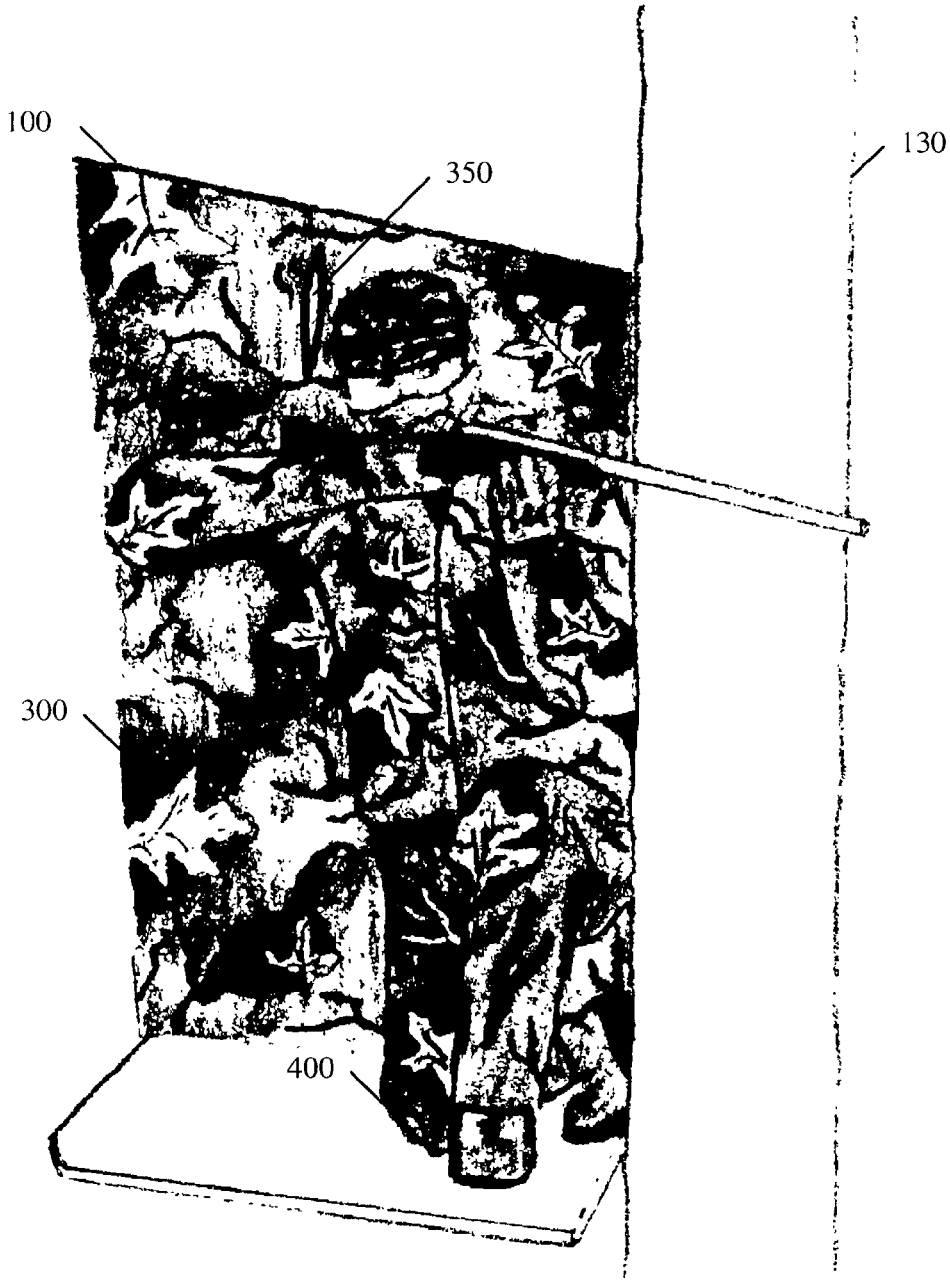

FIG. 4B and FIG. 4C

FIG. 4B shows a person observing wildlife from a tree stand without the benefit of the present invention. As explained earlier, the person makes a silhouette against the background and is observable from 360 degrees. FIG. 4C shows the same person shielded by the present invention. In the method of present invention, first, the operator 400 attaches the attaching pivoting support 100 to the attaching structure 130 (in this example a tree). Next the operator 400 hides in front of the curtain 300. This novel approach revolutionizes wildlife observation. It eliminates the silhouette of the operator 400. It is believed that most animals see primarily black and white. This method removes one of the animals' best sensing abilities. The approach allows the operator 400 to observe 180 degrees in front of him, or her, and to be free from worrying about what is in the 180 degrees behind him, or her. The operator 400 is free to eat, drink, modify clothing, etc. when it is clear to do so and hide for ½ of the observation area that is behind him, or her. The slit 350 can be placed in the curtain 300 (as shown in FIG. 3B, 3E, and 3L). The operator 400 can peek through the slit 350 to see if any wildlife is approaching; this can be done without moving the position of the second leg 160.

Figure 4D:
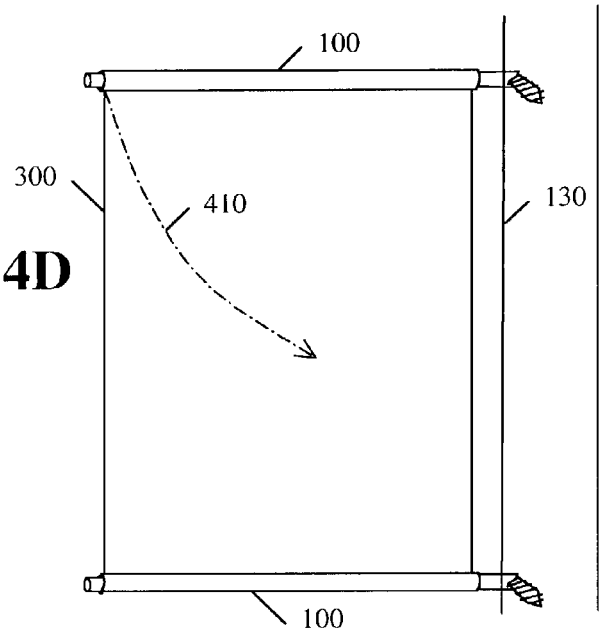

FIG. 4D shows an embodiment of the present invention where the curtain 300 is held in taut by two attaching pivoting supports 100: one at the top and one at the bottom. Either attaching pivoting support 100 can be moved independently. When the curtain 300 is taut, raising the top will cause both supports 100 to raise in parallel, and lowering the bottom will cause both supports 100 to lower in parallel.

Figure 4E:
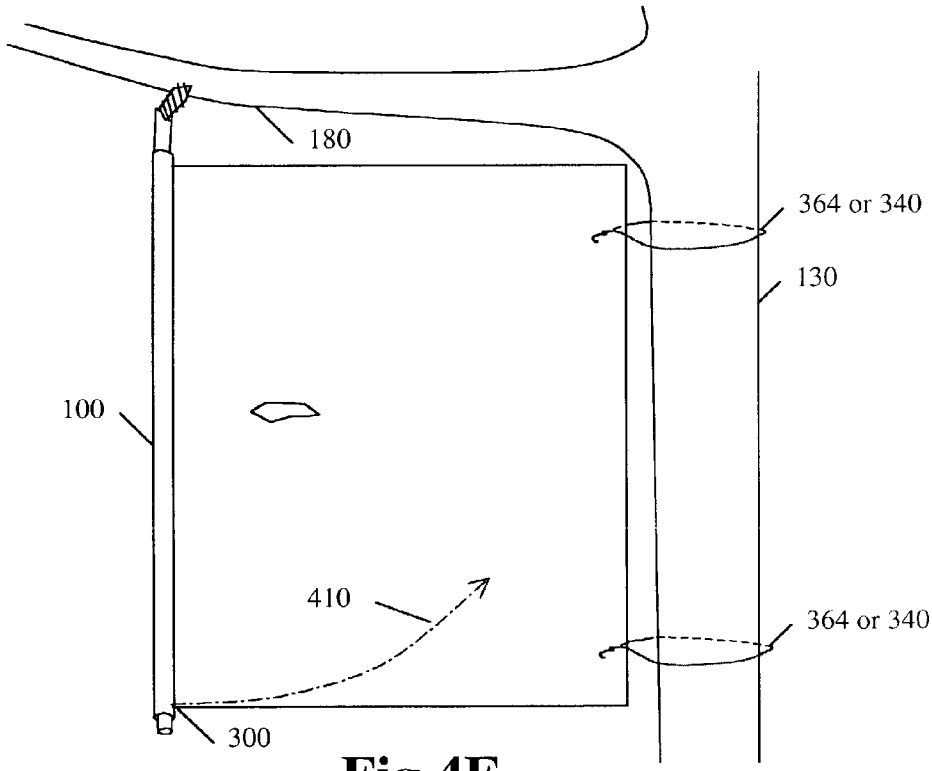
Figure 5A:
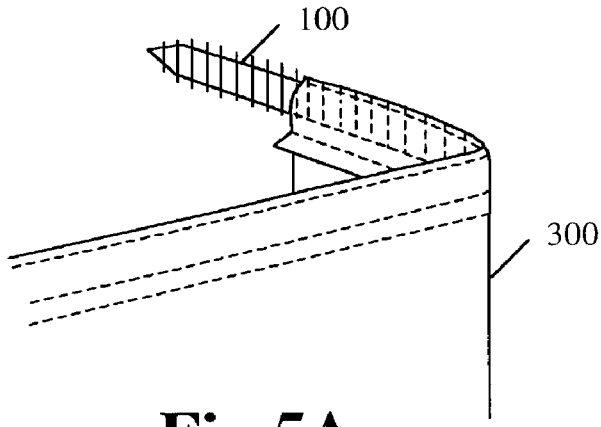
FIG. 5A through FIG. 5C show embodiments of curtain attachments.
Figure 5B:
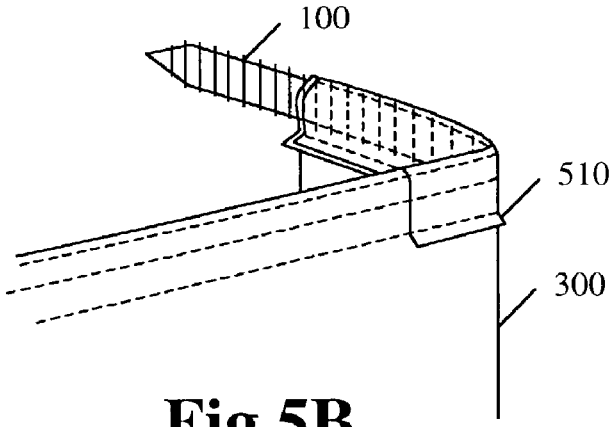
Figure 5C:
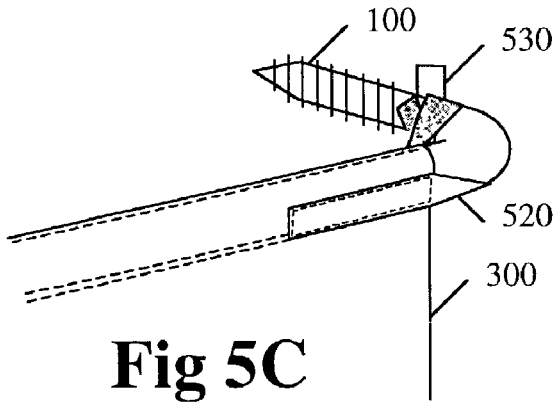

FIG. 4E shows a use of the present invention where the attaching pivoting support 100 is attached to a horizontal structure 180, such as a tree limb or rafter, and positioned vertically. The ties 340 or the drawstrings 364 pass around a vertical object such as the tree trunk or a pole, so that the curtain 300 is held generally horizontally FIG. 5A through FIG. 5C FIG. 5A shows an embodiment of the present invention where the curtain 300 is held in its place simply by putting it over the exposed threads of the first leg 150. Good results have been found with a woven fabric catching on the threads and holding the curtain 300 in place.

FIG. 5B shows an embodiment of the present invention where the area of the curtain 300 that comes in contact with the exposed threads of the first leg 150 is reinforced for longer wear. A hem reinforcement 510 is made by using multiple layers of material.

FIG. 5C shows an embodiment of the present invention where the curtain 300 is held in place with a fastening strap 520 that connects over the first leg 150. Good results have been obtained by making the fastening strap 520 with a cord or loop of material. As shown in FIG. 5C the fastening strap 520 could also comprise a hook and loop fastener 530. The hook and loop fastener 530 is advantageous for quick assembly and disassembly.

The present invention anticipates that other similar means may be used to hold the curtain 300 in place.

FIG. 6A through FIG. 6D

Figure 6A:
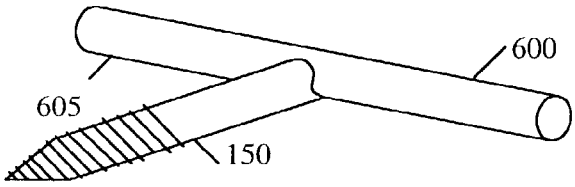
FIG. 6A through FIG. 6D show T-shaped embodiments of the present invention.

FIG. 6A shows a major variation of the attaching pivoting support 100. A T-shaped support 600 comprises the first leg 150 attached to a cross bar 605. The cross bar 605 could be bent at an angle or curved. The user screws the T-shaped support 600 into the attaching structure 130 by rotating the cross bar 605.

Figure 6B:
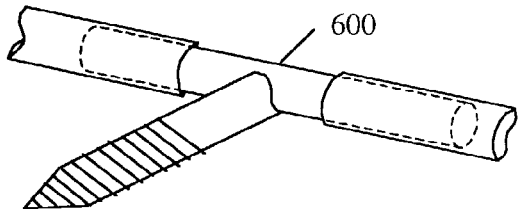

FIG. 6B shows the T-shaped support 600 inserted into two ends of a ring 630 (not shown in FIG. 6B): a first ring end 610, on one leg of the cross bar 605, and a second ring end 620, on the opposite leg. Both ring ends have cavities for receiving the ends of the cross bar 605.

Figure 6C:
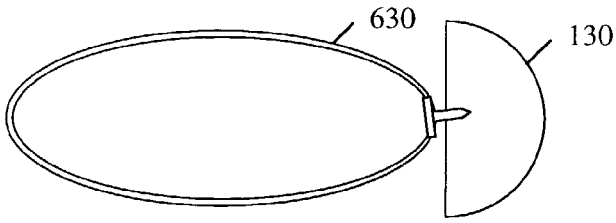

FIG. 6C shows the ring 630 extending from the attaching structure 130 supported by the T-shaped support 600. Good results have been obtained by making the T-shaped support 600 with hardened steel and making the ring 630 with a semi-rigid tube of plastic or a flexible shaft.

Figure 6D:
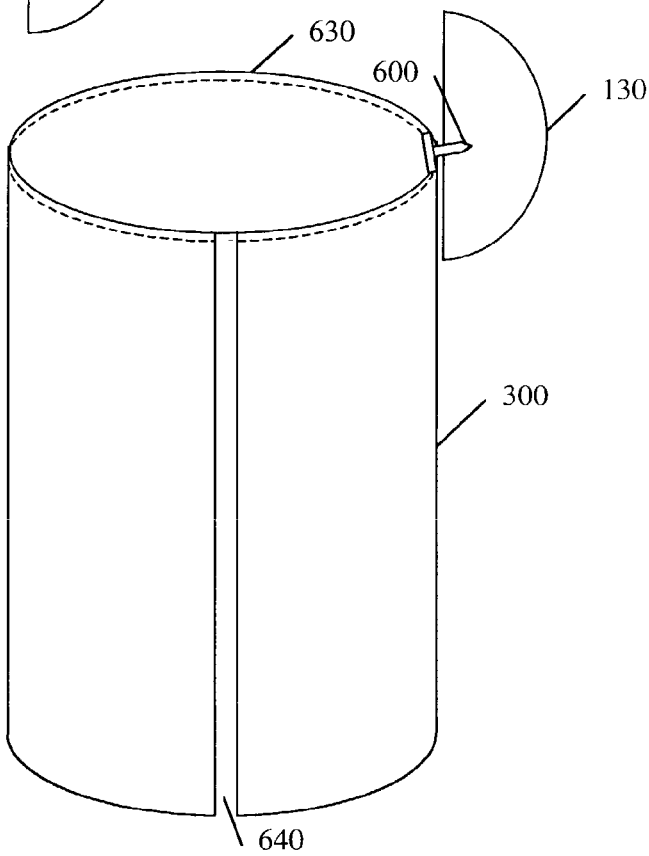

FIG. 6D shows the curtain 300 hanging from the ring 630. The edges of the curtain 300 form a curtain opening 640. The curtain opening 640 provides an entrance and exit. The curtain opening 640 further provides a viewing slit while the curtain maintains a backdrop to prevent an animal or person from seeing a silhouette. The curtain opening 640 provides a path for shooting film, arrows, and bullets.

FIG. 7A through FIG. 7G

It is anticipated by the present invention that the ring 630 could be made from multiple shafts connected permanently or temporarily by various connectors.

Figure 7A:
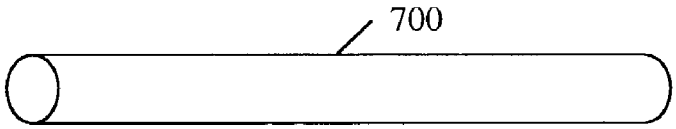
FIG. 7A through FIG. 7G show connectors and their use.

FIG. 7A shows the straight connector 700.

Figure 7B:
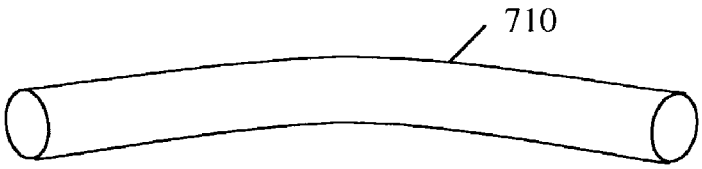

FIG. 7B shows an angled connector 710. The angle is obtuse.

Figure 7C:
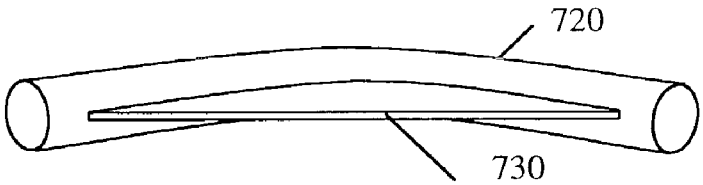

FIG. 7C shows a reinforced angled connector 720. Tests have shown that the connector receives substantial force and, depending on the strength of the material, connector reinforcement 730 may be necessary.

Good results have been obtained by making these connectors with aluminum alloy tubes or plastic.

Figure 7D:
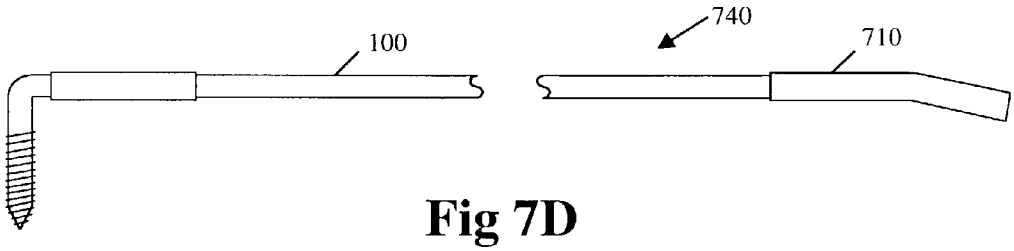

FIG. 7D shows a "support with angled connector" 740 comprising the attaching pivoting support 100 and a connector, either the angled connector 710 (shown), the straight connector 700, or the reinforced angled connector 720.

Figure 7E:
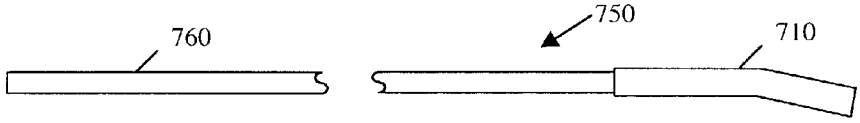

FIG. 7E shows a "shaft with angled connector" 750 comprising a connected shaft 760 and a connector: either the angled connector 710 (shown), the straight connector 700, or the reinforced angled connector 720.

Figure 7F:
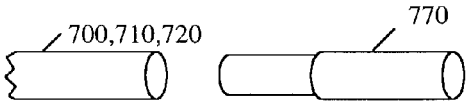

FIG. 7F shows a connector with a connector insert 770. When the shaft 106 is inserted into a connector and a sideways (lateral) force is applied to the shaft 106, the material of the shaft 106 may breakdown. For example, a fiberglass shaft may break or fray. To avoid this problem, any shaft 106 can be protected by attaching the connector insert 770 to the end of the shaft 106. The connector insert 770 has a section, with smaller dimensions than the shaft receiving section, that can be inserted into a hollow connector such as the straight connector 700, the angled connector 710, the reinforced angled connector 720, or a flexible connector 790. The sideways (lateral) forces are transferred through the material of the connector insert 770. Good results have been obtained by making the connector insert 770 from metal or plastic and attaching it to the end of the shaft 106 with glue.

Figure 7G:
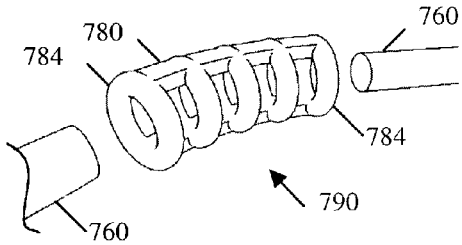

FIG. 7G shows an embodiment of the flexible connector 790. The flexible connector 790 allows the components that it connects to move side to side (laterally) but not up and down. The flexible connector can be comprised of a flexible top rail 780, a flexible bottom rail 782, and a plurality of rail rings 784. The top rail 780 and the bottom rail 782 allow the connector to flex side to side but resist up and down flexing. The rail rings 784 hold the rails together and act as receivers for the shafts 106 or narrow sections of the connector inserts 770. The rail rings 784 also limit the amount of side to side flexing.

FIG. 8A through FIG. 8E

Figure 8A:
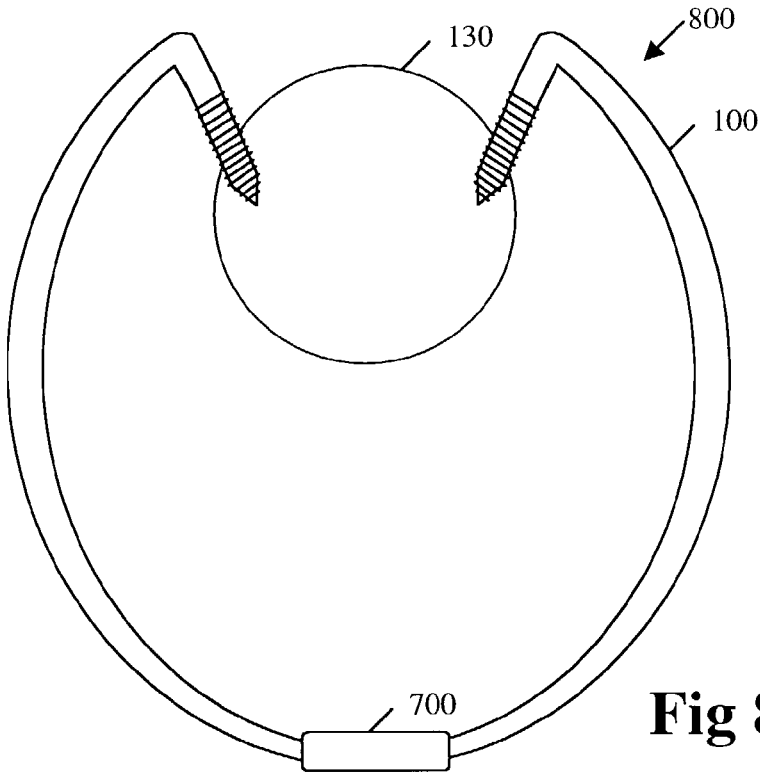

FIG. 8A shows a double support ring 800, namely, two of the attaching pivoting supports 100 attached to the same attaching structure 130, the respective second leg 160 of each support being connected with a connector: such as the straight connector 700 (shown), the angled connector 710, the reinforced angled connector 720, or similar connector.

Figure 8B:
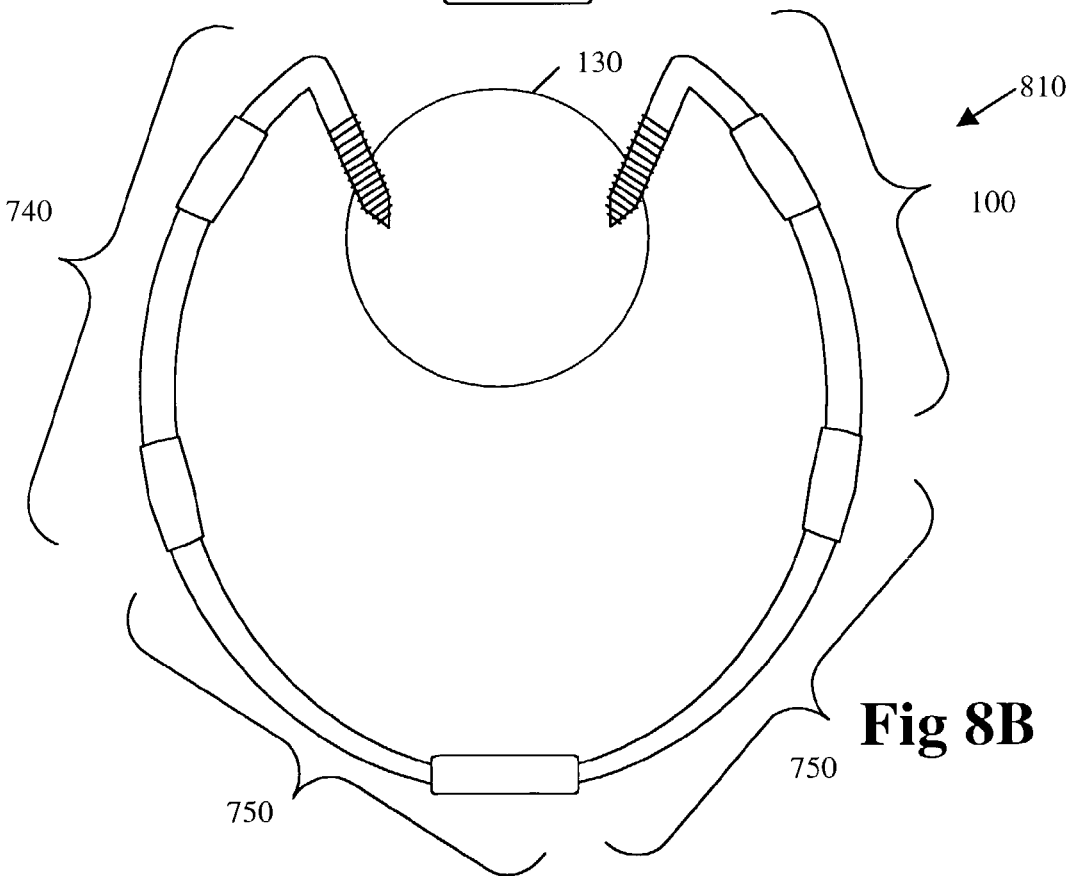

FIG. 8B shows a substantially similar structure, a segmented ring 810 comprising one "support with angled connector" 740 (as shown and explained with FIG. 7D), multiple "shafts with angled connectors" 750, and one attaching pivoting support 100.

Both the double support ring 800 and the segmented ring 810 shown in FIG. 8A and FIG. 8B, respectively, can pivot up and down by virtue of the pivoting of each first leg 150. The present invention anticipates that substantially similar pivoting support structures could be constructed of with any number of supports, shafts, and connectors.

FIG. 8C shows a curtained ring 820 comprised of either the double support ring 800 or the segmented ring 810 and one or more curtain(s) 300. The curtained ring 820 is attached to the attaching structure 130.

FIG. 8D shows variation of the segmented ring 810 (shown in FIG. 8B) comprising one "support with angled connector" 740 (as shown and explained with FIG. 7D), multiple "shafts with angled connectors" 750, and one attaching pivoting support 100. However, in this embodiment, the attaching pivoting support 100 and the angled connector 740 have obtuse angles. As explained before, the obtuse angles help avoid obstructions when attaching. This embodiment has the added advantage of excluding the attaching structure 130 from the concealed area, thus allowing more room for the user.

The elastic cord 126 running through the centers of a group of ring or hoop components (such as 100, 700, 710, 720. 740, 750, 760, 770, or 790) can connect the components. This can prevent components from falling and makes it easier to assemble the rings 360, 800, 810, 820 or hoop 910.

Figure 8E:
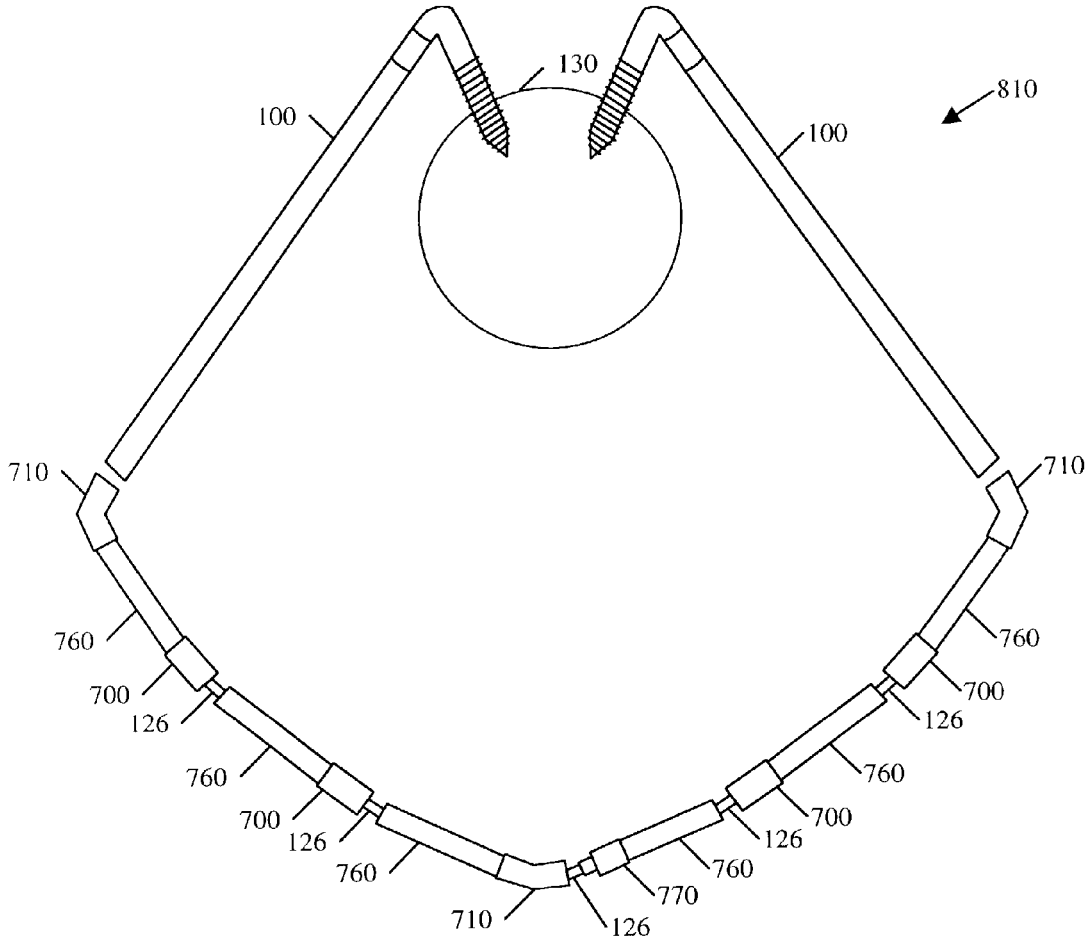

FIG. 8E shows an alternate embodiment of the segmented ring 8 10 where two attaching pivoting support attach to the attaching structure 130. The remaining components of the segmented ring 810 comprise a plurality of angled connectors 710, connected shafts 760, straight connectors 700, and connector inserts 770, all connected together by the elastic cord 126.

FIG. 9A through FIG. 9E

Figure 9A:
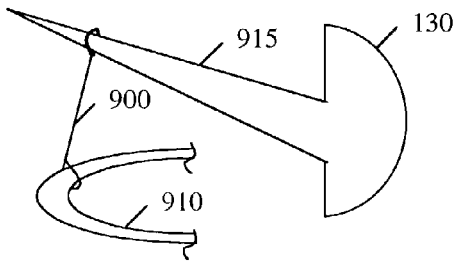
FIG. 9A through FIG. 9E show details of loop support with a supporting cord.

FIG. 9A shows the supporting cord 900 supporting a hoop 910. The hoop 910 represents either the attaching pivoting support 100, the ring 630 (shown in FIG. 6C and FIG. 6D), the double support ring 800 (shown in FIG. 8A), the segmented ring 810 (shown in FIG. 8B, FIG. 8C and FIG. 8D), or an equivalent structure. In the example shown in FIG. 9A the supporting cord 900 is attached to an overhead structure 915, such as a tree limb, a scaffold, or other overhead element.

Figure 9B:
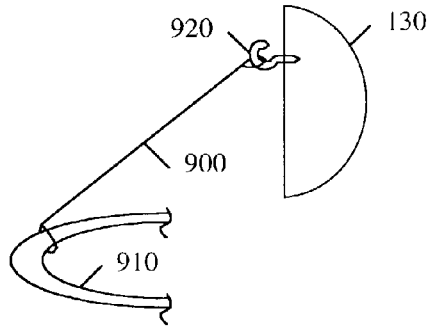

FIG. 9B shows the supporting cord 900 attached to an eye fastener 920. In the example shown in FIG. 9B the eye fastener 920 is screwed into the attaching structure 130 at a point higher than the hoop 910 is attached.

Figure 9C:
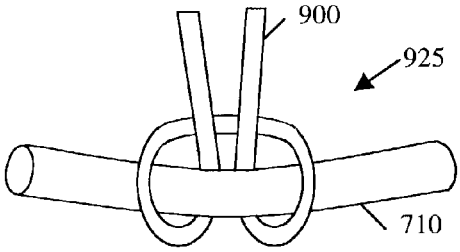

FIG. 9C shows a knotted connector 925. The supporting cord 900 is tied around a connector. Good results have been obtained by tying a lark's head knot over the angled connector 710 as shown. The present invention anticipates that other knots, for example two half hitches, clove hitch, timber hitch, bow line, taut line, bow knot, slip knot, and the like could be substituted. The present invention anticipates that such knots could be tied anywhere on the hoop 910 as shown in FIG. 9A and FIG. 9B.

Figure 9D:
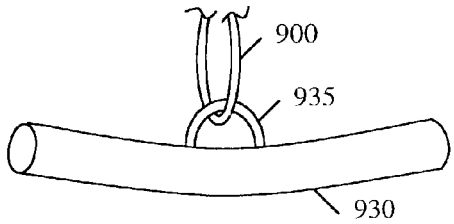

FIG. 9D shows a connector with eye loop 930. The supporting cord 900 passes through an eye loop 935 comprising part of the connector.

Figure 9E:
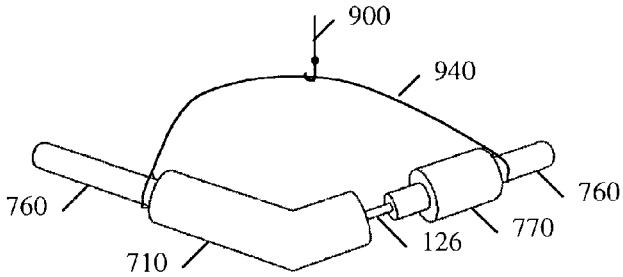

FIG. 9E shows the section of the segmented ring 810 shown is FIG. 8E being supported by the supporting cord 900 and a second cord 940. The second cord 940 is tied around the connected shaft 760 next to the angled connector 710 at one end and around the connected shaft 760 next to the connector insert 770 at the other end. The second cord 940 distributes the force from the supporting cord 900 to the segment ring 810 at two points. The raised edges of the angled connector 710 and the connector insert 770 prevent the second cord 940 from slipping inward. Because the second cord 940 connects the two components, the elastic cord 126 between them is redundant and could be eliminated.

In these embodiments one or more cords 900 help support the weight of the hoop 910 and the curtain 300 (not shown) so that the hoop 910 and its components can be of lighter weight and support a heavier load.

FIG. 10A through FIG. 10F

A number of tree steps are known in the art. The present invention anticipates that the attaching pivoting support 100 could attach to an attaching structure 130 comprising an improved tree step and pivot about its connection to the tree step at a friction pivot joint 1025. FIG. 10A through FIG. 10F show various embodiments of the attaching pivoting support 100 in combination with various tree steps. In each example, the attaching structure 130 includes an improved tree step. It should be anticipated that any tree step could be used in a similar manner in the present invention.

Figure 10A:
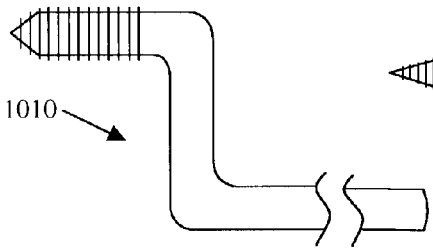
FIG. 10A through FIG. 10F show alternate embodiments.

FIG. 10A shows a first example 1010 where an embodiment of the present invention which is formed by additional bends in the attaching pivoting support 100. A similar but not equivalent tree step based device with three or more legs is show in U.S. Pat. No. 5,908,084, entitled "Lifting and raising device", however, the present invention is not described or claimed by Laurin et al.

Figure 10B:
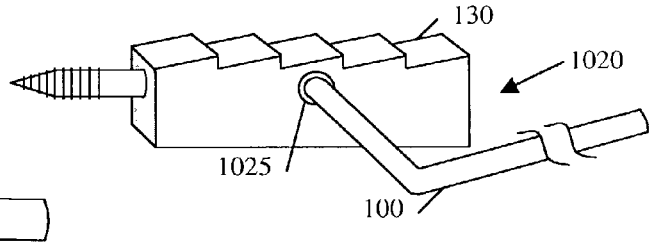

FIG. 10B shows a second example 1020 where the attaching pivoting support 100 is combined with the tree step shown in U.S. Pat. No. 5,279,388, entitled "Tree climber or step device", however, the present invention is not described or claimed by Laughlin et al.

Figure 10C:
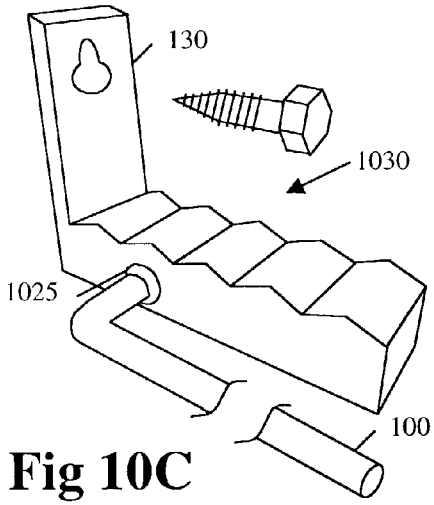

FIG. 10C shows a third example 1030 where the attaching pivoting support 100 is combined with the tree step shown in U.S. Pat. No. 4,867,272, entitled "Steps for climbing trees", however, the present invention is not described or claimed by Troubridge.

Figure 10D:
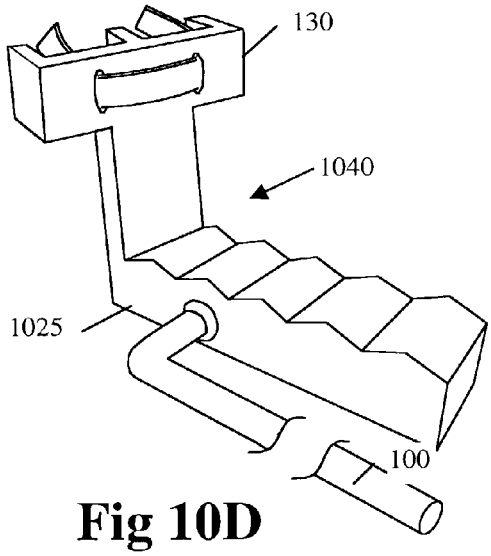

FIG. 10D shows a fourth example 1040 where the attaching pivoting support 100 is combined with the tree step shown in U.S. Pat. No. 4,000,788, entitled "Belt-on tree step (BOTS)", however, the present invention is not described or claimed by Burgess et al.

Figure 10E:
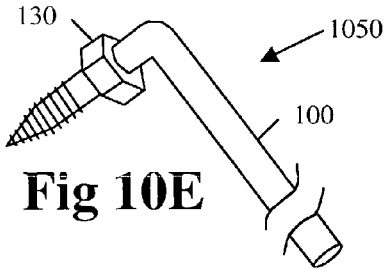

FIG. 10E shows a fifth example 1050 where the attaching pivoting support 100 is combined with a component of the tree step shown in U.S. Pat. No. 4,775,030, entitled "Tree step", however, the present invention is not described or claimed by Wright.

Figure 10F:
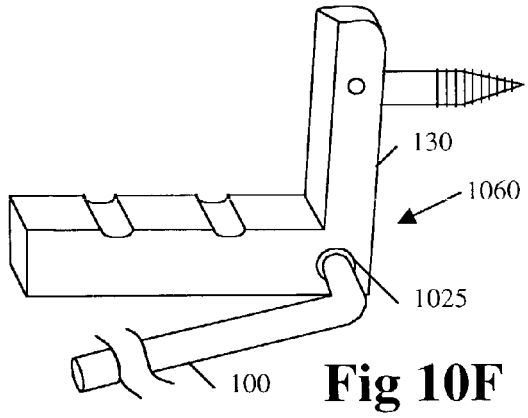

FIG. 10F shows a sixth example 1060 where the attaching pivoting support 100 is combined with the tree step shown in U.S. Pat. No. 4,697,669, entitled "Folding portable tree step", however, the present invention is not described or claimed by Bergsten.

FIG. 11A

FIG. 11A shows the attaching pivoting support 100, in the embodiment shown in FIG. 1F and FIG. 2B, connected to the attaching belt 200. In this embodiment the strap 210 passes through holes in each end of, and under, the attaching fastener 230. This embodiment shows the use of the threaded connector 104 for attaching the shaft 106 to the plate connection 112. The shaft 106 passes through the plate sleeve 114 for added support. The attaching pivoting support may be rotated around the pivot point along the path 410 (as is show in FIG. 4A). The friction between the plate 110 and the attaching fastener 230 holds the device in position.

FIG. 11B

Figure 11B:
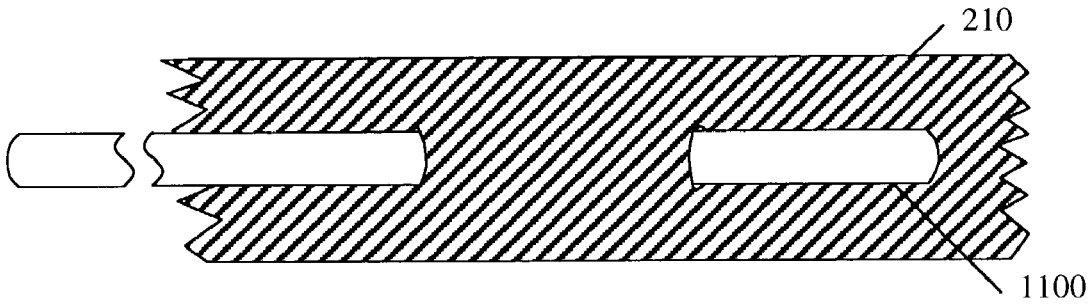

FIG. 11B shows a simple embodiment where the attaching pivoting support 100 passes through the strap 210 via two strap holes 1100. The tension of the strap 210 against the attaching structure 130 holds the attaching pivoting support 100 in place. The attaching pivoting support 100 can be bent at an angle and pivot in the strap holes 1100.

FIG. 11C

Figure 11C:
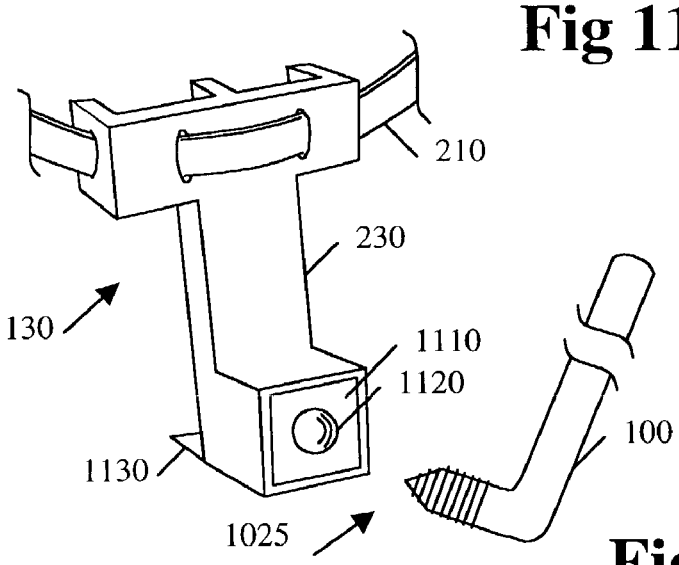

FIG. 11C shows an embodiment where the attaching pivoting support 100 connects to the attaching structure 130 comprising the strap 210 and the attaching fastener 230. The attaching fastener 230 provides the friction pivot joint 1025 with the first leg 150. The friction pivot joint 1025 comprises attaching material 1110, attached to the attaching fastener 230, and having a threaded attaching hole 1120. An optional tooth 1130 on the back of the attaching fastener 230 provides torque resistance.

Good results have been found making the attaching fastener 230 of metal and the attaching material 1110 of a high polymer plastic as known in the art.

FIG. 11D

Figure 11D:
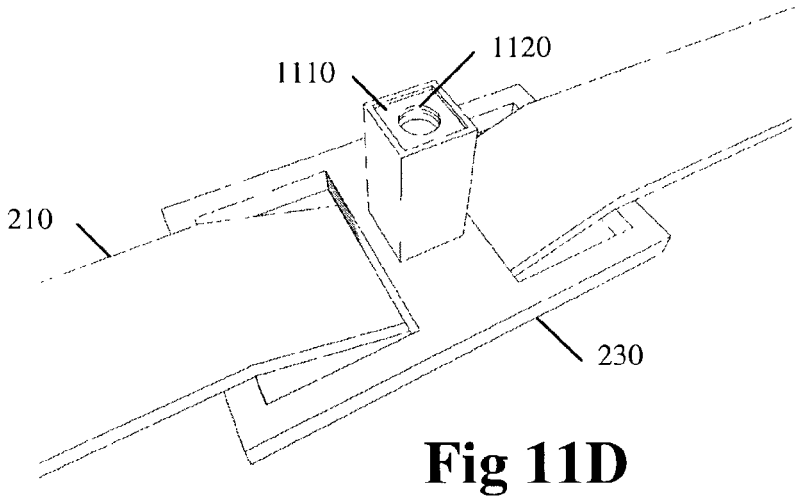

FIG. 11D shows an alternate embodiment of the attaching fastener 230. In this embodiment torque resistance is provided by the strap 210.

FIG. 11E

Figure 11E:
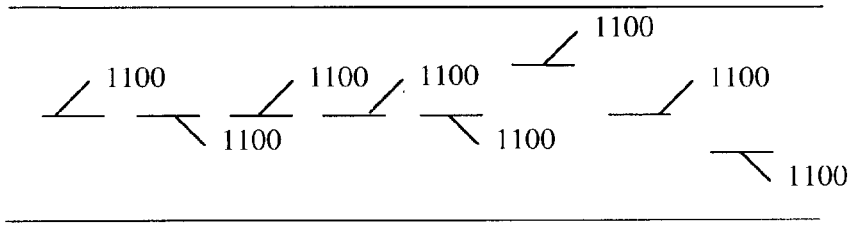

FIG. 11E shows an alternate embodiment strap 210 with more than two strap holes 1100. In this embodiment the attaching pivoting support 100 can pass through any two or more of the strap holes 1100. For example, if the strap 210 is attached to a small diameter tree, then the attaching pivoting support 100 could be passed through strap holes 1100 that are close to each other. On the other hand if the strap 210 is attached to a large diameter tree it may be necessary to pass the attaching pivoting support 100 through strap holes 1100 that are farther from each other to apply the necessary friction.

FIG. 11F

Figure 11F:
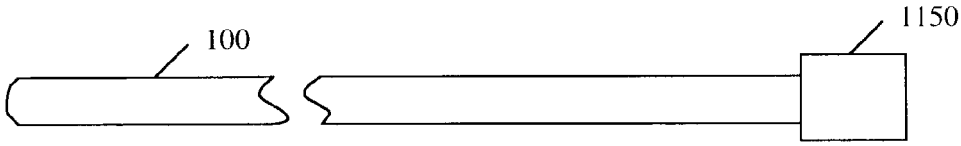

FIG. 11F shows an embodiment where one end of the shaft 106 of the attaching pivoting support 100 has a enlarged end that acts as a stopper 1150 to prevent it from passing through the strap holes 1110.

FIG. 12

Figure 12:
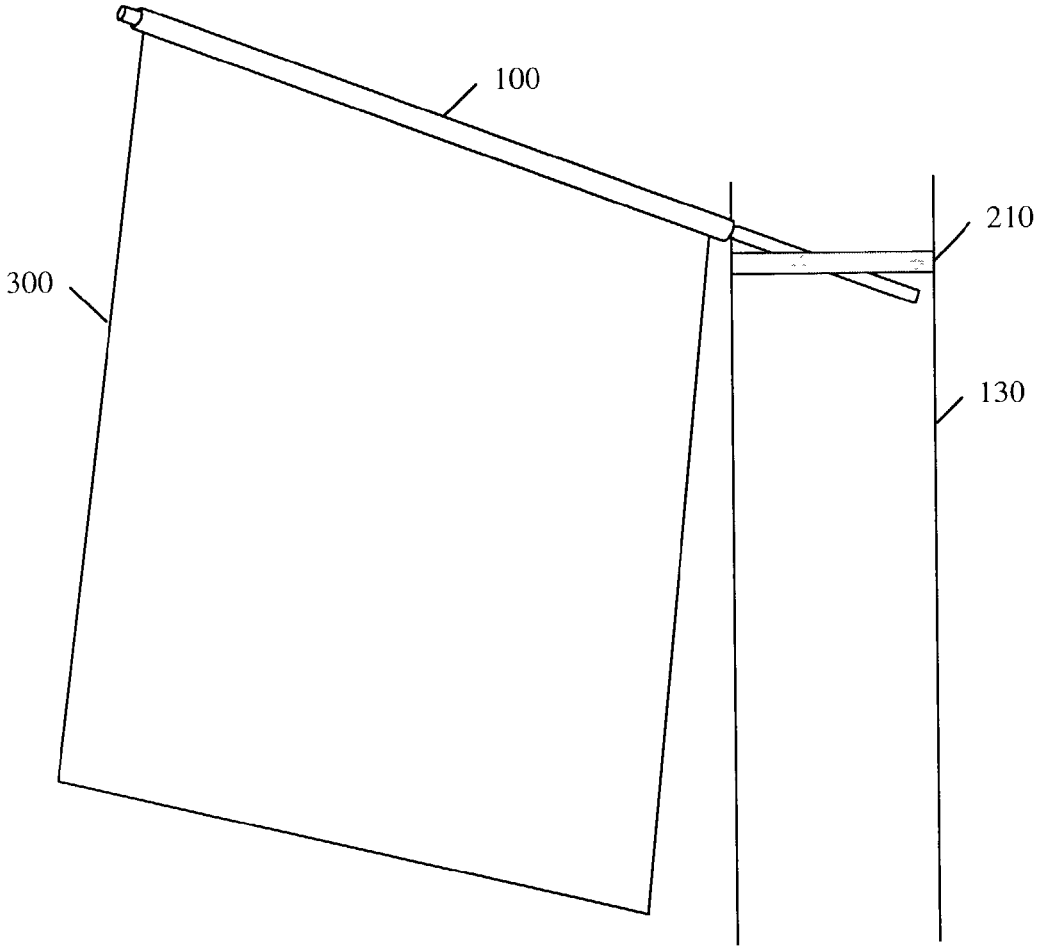
FIG. 12 shows an alternate embodiment.

FIG. 12 shows an alternate embodiment of the present invention where the attaching pivoting support 100 comprises the shaft 106 that passes under the strap 210. In this embodiment the pressure and friction of the strap 210 is sufficient to attach and to provide a pivot point for the attaching pivoting support 100. The curtain 300 is supported by the attaching pivoting support 100.

FIG. 13

Figure 13:
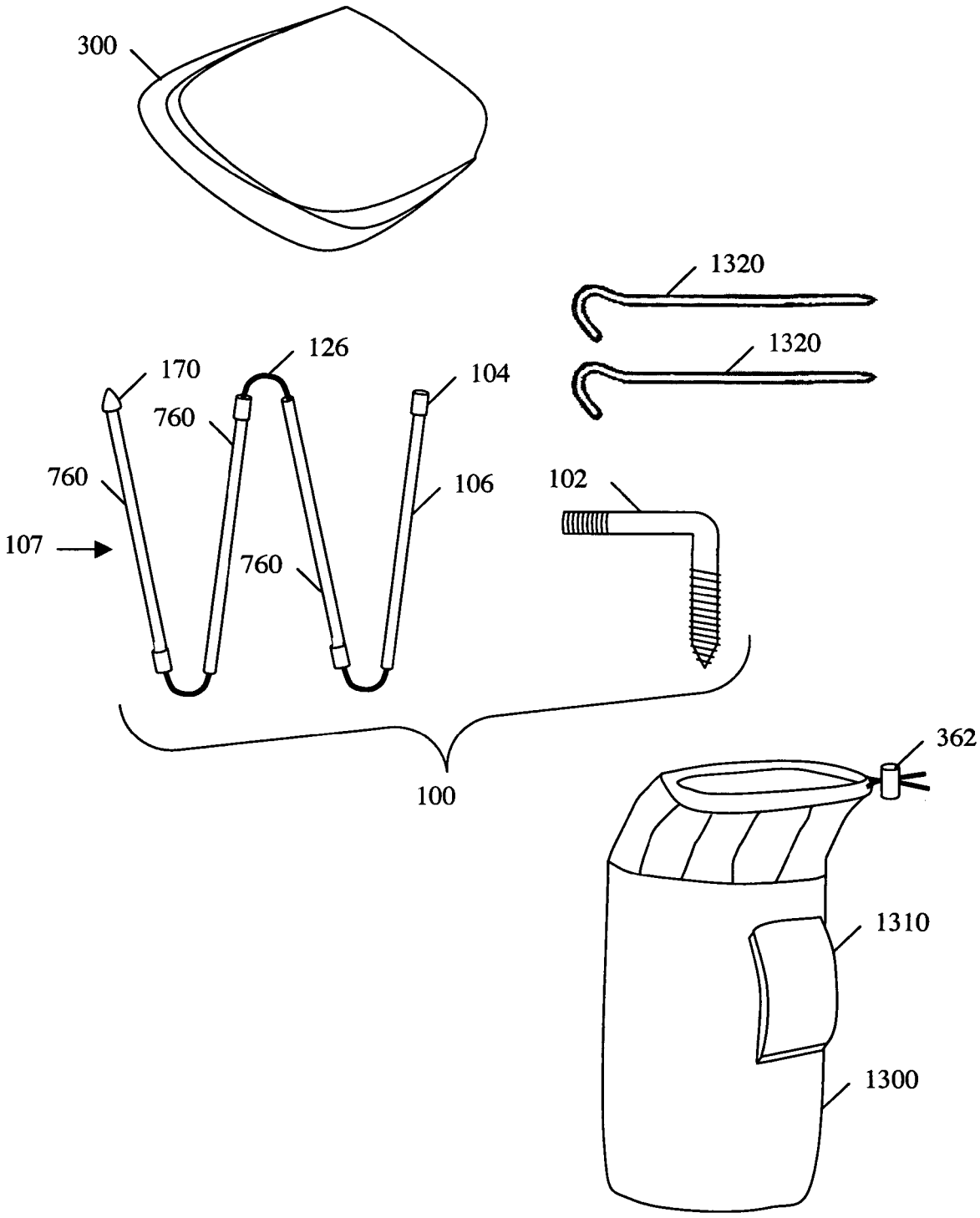
FIG. 13 shows an exemplary lightweight portable embodiment.

FIG. 13 shows a light weight, portable embodiment of the present invention, known as the Pocket UnBlind. FIG. 13 shows a folded curtain 300; a collapsed attaching pivoting support 100 (shown disassembled into two separte pieces) comprised of the threaded support 102 and, the segmented shaft 107 with cap 170 held together by the elastic cord 126; a plurality of stakes 1320; and a carrying case 1300. The case 1300, which can hold all of the other components, is shown with a belt loop 1310, which makes it easy to carry. The case is closed with the drawstring 364, which can be held closed with a knot or the drawstring clip 362. Each stake 1320 can be put in the ground, tree, or other substance to make a fixed object to which the ties 340 or drawstrings 364 of the curtain 300 can be attached. With the stakes, the same blind can be used, for example, in a tree stand for hunting deer in the fall and on the ground for hunting turkey in the spring.

ADVANTAGES

Simple

The present invention is simple to make and use. It contains fewer components than other devices in the field of this invention. Each component is easily made. The present invention requires little time to attach and to set up.

Easy to Use

The present invention is easy to use. To install, the operator 400 simply attaches the support and optional shafts, connectors, or curtains. To use, the support is raised or lowered.

Light Weight

The present invention comprises a few simple parts that can easily be constructed of lightweight materials. Being lightweight is important for those who have to carry gear into the outdoors.

Compact

The present invention is compact. The support, shafts, connectors, and curtains can easily be rolled together into a small bundle or placed in a slender sack such as the case 1300. This is advantageous for both storage and carrying.

Portable

The present invention is lightweight and compact allowing it to be carried long distances into the outdoors and to be used in a variety of locations. The curtain 300 can be folded or rolled up with various components of the attaching pivoting support 100 and placed in the case 1300 for easily carrying on a waist belt or in a backpack.

Quiet

The present invention has no moving parts that would make a noise or rattle together. In some cases the screws turning against the attaching structure could make a quiet sound. However the design is such that once screwed in all the way the screw can be backed out a turn or two to reduce the volume of noise made to a negligible level.

Further, the tension on the curtain 300 provided by the second leg 160 and the anchor points 310 and ties 340 reduce wind noise.

Conclusion, Ramification, and Scope

Accordingly, the reader will see that the present invention provides an easy to use, simple, lightweight, compact, portable, quiet, multi-use means of concealment and methods for its construction and use.

While my above descriptions contain several specifics these should not be construed as limitations on the scope of the invention, but rather as examples of some of the preferred embodiments thereof. Many other variations are possible. For example, other embodiments of a means of concealment include various construction materials, multiple cords or shafts or connections.

Accordingly, the scope of the invention should be determined not by the embodiments illustrated, but by the appended claims and their legal equivalents.

I claim:

1. An attaching pivoting support for supporting a curtain in the outdoors, said support having at least two legs, wherein one leg of said support is threaded, having screw-like threads, and is threadedly attached to an attaching structure, said attaching structure selected from one of:

i) a tall and narrow wooden, outdoor structure, such as a tree or post; and ii) an attaching fastener attached to an outdoor structure, wherein said support pivots around the axis of the threaded leg at the attachment of the threadcd leg to the attaching structure, wherein applying an inserting rotational force on the threaded leg increases the frictional force between the threads and the attaching structure wherein said curtain, having a predetermined curtain weight is supported by another leg which is held in an angular position by the friction of the attachment, wherein the leg supporting said current curtain has sufficient length along the axis of said supporting leg to support substantially the entire length of one edge of the curtain, whereby when the supporting leg is positioned by an operator at a lowered angle that is below horizontal, the supporting leg and curtain weight is held at the lowered angle by said frictional force and, later when the supporting leg is positioned by the operator at a raised angle that is above the lowered angle, the supporting leg and the curtain weight is held at the raised angle by said frictional force.

2. The attaching pivoting support of claim 1 wherein said support is bent at an angle forming a first leg and a second leg.

3. The attaching pivoting support of claim 2 wherein said angle is 90 degrees.

4. The attaching pivoting support of claim 2 wherein said angle is greater than 90 degrees.

5. The attaching pivoting support of claim 2 wherein said angle is less than 90 degrees.

6. The attaching pivoting support of claim 2 further comprising a connector and a shaft, wherein said second leg of said support is extended by connecting said second leg to said connector and connecting said connector to said shaft.

7. The attaching pivoting support of claim 6, wherein said second leg and said connector are threadedly attached, and wherein said connector and said shaft are permanently connected forming a connected shaft, whereby said second leg can be connected and disconnected from said connected shaft.

8. The attaching pivoting support of claim 2 further comprising a drilled connection shaft and a fastener, wherein said second leg of said support is drilled being a drilled support, and wherein said drilled support and said drilled connection shaft are held together by said fastener.

9. The attaching pivoting support of claim 2, further comprising a shaft, wherein said first leg further comprises a plate with a plate sleeve, and wherein said second leg is a plate connection, and wherein said shaft passes through said plate sleeve and attaches to said plate connection, whereby said first leg is threadedly attached to said attaching structure, and whereby said second leg is extended by said shaft to support said curtain.

10. The attaching pivoting support of claim 6, wherein said shaft is comprised of a plurality of connected shafts, each connected shaft comprised of a shorter shaft and a connector, whereby said shaft can be broken down to a shorter length.

11. The attaching pivoting support of claim 10 wherein said plurality of connected shafts are held together by an elastic cord, whereby said plurality of connected shafts can remain together and can be reassembled to reform said shaft.

12. The attaching pivoting support of claim 6 wherein said shaft is a telescoping shaft.

13. The attaching pivoting support of claim 9, wherein said attaching structure comprises an attaching fastener, having a threaded receptor, and an attaching belt, wherein said threaded first leg attaches and pivots at said threaded receptor, and wherein said plate provides resistance against said attaching fastener.

14. A system for concealment comprising:

a) one or more of the attaching pivoting supports of claim 1, b) and one or more curtains.

15. A system comprising the attaching pivoting support of claim 1 and a curtain, said curtain comprising:

a) a sheet of material, and b) a support hem, wherein the supporting leg passes through said support hem, whereby said curtain is supported by said support.

16. The curtain of claim 15 wherein said curtain further comprises grommets forming anchor points.

17. The curtain of claim 15 wherein said curtain further comprises a plurality of ties.

18. The curtain of claim 15 wherein said curtain further comprises a hem reinforcement.

19. The curtain of claim 15 wherein said curtain further comprises a fastening swap.

20. The curtain of claim 15 wherein said curtain further comprises one or more hems, wherein a drawstring can be passed through each hem, whereby the curtain length and shape can be modified by tightening the drawstrings.

21. The curtain of claim 20 further comprising a plurality of grommets, wherein said each drawstring can be fastened to one of said grommets at one end and the other end of said drawstring can be passed through a drawstring clip, whereby said curtain can be held taut in a desired shape by said drawstrings.

22. The curtain of claim 15 further comprising an opening being one of a slit or a window, whereby the operator can perform an action through said opening, said action being one of seeing or shooting.

23. The curtain of claim 22 further comprising a means for holding said opening in an open position while said operation performs said action.

24. The attaching pivoting support of claim 1 being a T-shaped support.

25. A hoop comprising the attaching pivoting support of claim 24 and a ring.

26. A system for concealment comprising the hoop of claim 25 and one or more curtains.

27. A hoop comprising the attaching pivoting support of claim 1, a second attaching pivoting support, and a plurality of connectors and shafts, said supports and shafts connected with connectors to form said hoop.

28. The system of claim 14 wherein at least one attaching pivoting support comprises a hoop.

29. The system of claim 28 further comprising a supporting cord for providing support from an overhead structure, wherein said supporting cord is attached to said overhead structure.

30. The system of claim 14 further comprising a connector with eye loop and a supporting cord for providing support from an overhead structure, wherein said connector with eye loop is connected to said attaching pivoting support, and said supporting cord is connected to said connector with eye loop.

31. The attaching pivoting support of claim 1 further comprising a tree step.

32. A method of concealment comprising the steps:

a) attaching an attaching pivoting support to an attaching structure, said attaching structure selected from on of:

i) a tall and narrow wooden, outdoor structure, such as a tree or post; and ii) an attaching fastener attached to an outdoor structure;

wherein said support comprises at least two legs, wherein one leg of said support is threaded, having screw-like threads, and is threadedly attached to said attaching structure and said support pivots around the axis of the threaded leg at the attachment of the threaded leg to the attaching structure, b) applying an inserting, rotational force on the threaded leg such that the threaded leg is screwed into said attaching structure until a frictional force between the threads and the attaching surface is sufficient to hold another leg of said support at any desired angle, and, c) hanging a curtain on said another leg wherein said another leg is held at an angular position by the frictional force of the attachment, whereby the curtain weight is supported by said support at the angular position, whereby an operator is concealed by the curtain when said another leg is held in the angular position.

33. The method of concealment of claim 32 further comprising the step of;

d) pivoting the support around the axis of the threaded leg such that said another leg is positioned at an angle lower than horizontal wherein said another leg is held at a second lower angular position by the frictional force of the attachment, whereby the curtain weight is supported by said support at the lower angular position, whereby the operator is free to view past the top of the curtain when said another leg is held in the lower angular position.

34. A method of making the attaching pivoting support of claim 1 comprising the steps of:

a) forming a shaft with a sharpened and threaded end, b) bending said shaft at an angle to form a first leg and a second leg.

35. The method of claim 34 further comprising the step of:

c) attaching a curtain.

36. The system of claim 14 further comprising an attaching fastener and an attaching belt, wherein said attaching fastener comprises an attaching material containing an attaching hole, and, wherein the attaching pivoting support is attached to the attaching fastener, and wherein the attaching belt is attached to the attaching fastener, whereby said system can be attached to the outdoor structure via the attaching belt without damaging said structure.

37. The system of claim 14 further comprising a case for carrying said curtains and said supports.

* * * * *